US008038283B2

(12) United States Patent
Nakazawa et al.

(10) Patent No.: US 8,038,283 B2
(45) Date of Patent: Oct. 18, 2011

(54) INK-JET RECORDING APPARATUS

(75) Inventors: Yusuke Nakazawa, Kanagawa (JP); Seishi Kasai, Kanagawa (JP); Yasuyo Yokota, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 797 days.

(21) Appl. No.: 12/015,994

(22) Filed: Jan. 17, 2008

(65) Prior Publication Data

US 2008/0174650 A1 Jul. 24, 2008

(30) Foreign Application Priority Data

Jan. 18, 2007 (JP) ..... P2007-009164
Mar. 9, 2007 (JP) ..... P2007-059887

(51) Int. Cl.
*B41J 2/01* (2006.01)

(52) U.S. Cl. ..... 347/102

(58) Field of Classification Search ..... 347/102, 347/101

See application file for complete search history.

(56) References Cited

U.S. PATENT DOCUMENTS 5,202,950 A * 4/1993 Arego et al. ..... 385/146
2004/0179079 A1 9/2004 Yokoyama
2004/0189772 A1 9/2004 Arai
2004/0227801 A1* 11/2004 Kumamoto et al. ..... 347/102
2007/0257976 A1 11/2007 Takabayashi

FOREIGN PATENT DOCUMENTS

JP 08045476 A * 2/1996
JP 2004114607 A * 4/2004
JP 2004-237602 A 8/2004
JP 2004-314586 A 11/2004
WO WO-2006/061979 A1 6/2006

* cited by examiner

*Primary Examiner* — Matthew Luu
*Assistant Examiner* — Rut Patel
(74) *Attorney, Agent, or Firm* — Birch, Stewart, Kolasch & Birch, LLP

(57) ABSTRACT

The invention is directed to an ink-jet recording apparatus including: a recording medium transport unit as defined herein; a full-line ink-jet head as defined herein; and an ultraviolet light illumination unit as defined herein, wherein the ultraviolet light illumination unit comprises an aperture-type hot-cathode tube, or an ultraviolet-setting ink-jet recording apparatus including: a recording medium transport unit as defined herein; and ink-jet head as defined herein; and an ultraviolet light illumination unit as defined herein, wherein: the ultraviolet light illumination unit comprises plural aperture-type hot-cathode tubes and apertures of at least one set of aperture-type hot-cathode tubes are rotated so that an overlap of their illumination regions is increased.

3 Claims, 13 Drawing Sheets

APERTURE ANGLE θ = 45° TO 180°

APERTURE ANGLE θ = 45° TO 180°

INK-JET RECORDING APPARATUS

FIELD OF THE INVENTION

The present invention relates to an ultraviolet-setting inkjet recording apparatus. More particularly, the invention relates to an ultraviolet-setting ink-jet recording apparatus having a hot-cathode tube or tubes.

BACKGROUND OF THE INVENTION

Ink-jet recording apparatus which form an image by discharging an ink which is set when receiving the energy of ultraviolet light or an electron beam toward a recording medium using an ink-jet head and then applying energy to the ink have various features; for example, they are environment-friendly, can perform high-sped recording on various recording media, and can produce high-resolution images because the ink is less prone to soak into recording media.

In particular, the development of apparatus using an ultraviolet-setting ink is making rapid progress because of case of handling of a light source, compactness, etc. And what is called a single-pass ink-jet recording apparatus in which a web-like recording medium capable of being transported at high speed is used, a fixed head wide enough to perform recording over the full width of a recording medium is opposed to the recording medium, and recording is completed by only one pass of the recording medium under the head has been invented by taking advantage of high-speed fixing performance of the ultraviolet-setting ink.

When color printing is performed with such a single-pass ink-jet recording apparatus, fixed heads are arranged in the number of colors in the transport direction of a recording medium. To prevent mixing of inks of different colors, JP-A-2004-314586 discloses an apparatus in which a light illumination means is disposed downstream of the head of each color.

JP-A-2004-237602 discloses an ink-jet recording system using cation-type ultraviolet-setting inks and inexpensive cold cathode fluorescent tubes or hot cathode fluorescent tubes.

FIG. 6 shows a single-pass ink-jet recording apparatus disclosed in JP-A-2004-314586. In FIG. 6, reference numeral 60 denotes a conventional single-pass ink-jet recording apparatus. In the single-pass ink-jet recording apparatus 60, a recording medium S is pulled out of a recording medium roll 61 which is a roll-wound recording medium. First, a desired image of a Y (yellow)-color ultraviolet-setting ink is recorded on the recording medium S as it is transported under a Y-color full-line ink-jet head 63Y in which a large number of ink-jet nozzles are arranged in the width direction (i.e., in the direction perpendicular to the paper surface of FIG. 6) of the recording medium S. Immediately thereafter, the Y-color ink that has been discharged and placed on the recording medium S is fixed receiving an active energy ray as the recording medium S passes under an active-energy-ray-setting lamp 64. High light intensity is necessary for setting of the ink, and a very expensive high-pressure mercury lamp, medium-pressure mercury lamp, or metal halide lamp is used as the light source.

Then, a desired image of an M (magenta)-color ultraviolet-setting ink is recorded on the recording medium S as it is transported under an M-color full-line ink-jet head 63M in which a large number of ink-jet nozzles are arranged in the width direction of the recording medium S. Immediately thereafter, the M-color ink that has been discharged and placed on the recording medium S is fixed receiving an active energy ray as the recording medium S passes under another active-energy-ray-setting lamp 64.

Then, a desired image of a C (cyan)-color ultraviolet-setting ink is recorded on the recording medium S as it is transported under a C-color full-line ink-jet head 63C in which a large number of ink-jet nozzles are arranged in the width direction of the recording medium S. Immediately thereafter, the C-color ink that has been discharged and placed on the recording medium S is fixed receiving an active energy ray as the recording medium S passes under another active-energy-ray-setting lamp 64.

Finally, a desired image of a B (black)-color ultraviolet-setting ink is recorded on the recording medium S as it is transported under a B-color full-line ink-jet head 63B in which a large number of ink-jet nozzles are arranged in the width direction of the recording medium S. Immediately thereafter, the B-color ink that has been discharged and placed on the recording medium S is fixed receiving an active energy ray as the recording medium S passes under a metal halide lamp 65 which is higher in light intensity than the above-mentioned active-energy-ray-setting lamps 64. Four-color-ink recording is thus performed.

As described above, because of a superior high-speed fixing characteristic, ultraviolet-setting inks are applied to the above-described single-pass ink-jet recording apparatus. And several systems are now on the market which are advantageous in that, for example, they are high in productivity, enable image drawing on various recording media, and are environment-friendly.

On the other hand, high light intensity is necessary for setting inks, and a very expensive high-pressure mercury lamp, medium-pressure mercury lamp, metal halide lamp, or the like is used as each ink-setting light source.

FIG. 7 shows an ink-jet recording apparatus disclosed in JP-A-2004-237602 which uses inexpensive hot cathode fluorescent tubes. In FIG. 7, reference numeral 70 denotes a single-pass ink-jet recording apparatus; 71, a transport belt, 73, ink-jet heads (73Y: yellow head, 73M: magenta head, 73C: cyan head, 73B: black head); 74, inexpensive hot cathode fluorescent tubes; and 75, a light source which is higher in power than the hot cathode fluorescent tubes 74 and provides sufficient light intensity to set inks.

The invention of JP-A-2004-314586 has the following problems. That is, in the case of a high-productivity apparatus, the ultraviolet light illumination unit is expensive because the illumination light intensity needs to be increased to compensate for short illumination periods. To prevent mixing of inks, the apparatus become very costly. On the other hand, the invention of JP-A-2004-237602 has a problem that the setting characteristic is insufficient particularly under a high-speed condition because of low light intensity of the hot cathode fluorescent tubes.

SUMMARY OF THE INVENTION

The present invention has been made to solve the above problems, and an object of the invention is therefore to provide a compact and inexpensive ink-jet recording apparatus which is high in productivity because of a high fixing speed and can perform recording on various recording media.

To attain the above object, the invention recited in an aspect 1 of the invention provides an ink-jet recording apparatus having a recording medium transport unit for transporting a recording medium, a full-line ink-jet head whose length is approximately equal to a width of the recording medium, for discharging ink that can be set when illuminated with ultraviolet light toward the recording medium being transported by the recording medium transport unit on the basis of an image signal, and an ultraviolet light illumination unit for setting the ink that has been discharged and placed on the recording medium by the full-line ink-jet head, characterized in that the ultraviolet light illumination unit includes an aperture-type hot-cathode tube.

An aspect 2 of the invention is characterized in that, in the ink-jet recording apparatus of the aspect 1, an aperture angle of the aperture-type hot-cathode tube is in a range of 45° to 180°.

An aspect 3 of the invention is characterized in that, in the ink-jet recording apparatus of the aspect 2, plural hot-cathode tubes are arranged so as to be deviated from each other in a width direction of the recording medium.

An aspect 4 of the invention is characterized in that, in the ink-jet recording apparatus of the aspect 2 or 3, plural hot-cathode tubes are arranged parallel with each other in such a manner that thickness increasing directions of phosphor layers of the respective hot-cathode tubes are opposite to each other.

An aspect 5 of the invention is characterized in that, in the ink-jet recording apparatus of the aspect 1 or 2, the ultraviolet light illumination unit includes plural aperture-type hot-cathode tubes and distances of the respective aperture-type hot-cathode tubes to an illumination surface are set different from each other.

An aspect 6 of the invention is characterized in that, in the ink-jet recording apparatus of the aspect 1 or 2, the ultraviolet light illumination unit includes plural aperture-type hot-cathode tubes and center emission wavelengths of the respective aperture-type hot-cathode tubes are different from each other.

The above configurations make it possible to provide a compact and inexpensive ink-jet recording apparatus which is high in productivity because of a high fixing speed and can perform recording on various recording media.

To attain the above object, an aspect 7 of the invention provides an ultraviolet-setting ink-jet recording apparatus having a recording medium transport unit for transporting a recording medium, an ink-jet head for discharging ink that can be set when illuminated with ultraviolet light toward the recording medium being transported by the recording medium transport unit on the basis of an image signal, and an ultraviolet light illumination unit for setting the ink that has been discharged and placed on the recording medium by the ink-jet head, characterized in that the ultraviolet light illumination unit includes plural aperture-type hot-cathode tubes and apertures of at least one set of aperture-type hot-cathode tubes are rotated so that an overlap of their illumination regions is increased.

An aspect 8 of the invention is characterized in that, in the ultraviolet-setting ink-jet recording apparatus according to the aspect 7, the aperture of at least one of the at least one set of aperture-type hot-cathode tubes is rotated so that a line connecting a center axis of a cylinder of the hot-cathode tube and a center of the aperture is not perpendicular to the recording medium so that light intensity peaks of the at least one set of aperture-type hot-cathode tubes are located at the same position.

An aspect 9 of the invention is characterized in that, in the ultraviolet-setting ink-jet recording apparatus according to the aspect 7, aperture angles of the plural aperture-type hot-cathode tubes are in a range of 45° to 180°.

An aspect 10 of the invention is characterized in that, in the ultraviolet-setting ink-jet recording apparatus according to any one of the aspects 7 to 9, the plural hot-cathode tubes are arranged so as to be deviated from each other in a width direction of the recording medium.

An aspect 11 of the invention is characterized in that, in the ultraviolet-setting ink-jet recording apparatus according to any one of the aspects 7 to 9, center emission wavelengths of the plural respective aperture-type hot-cathode tubes are different from each other.

An aspect 12 of the invention is characterized in that, in the ultraviolet-setting ink-jet recording apparatus according to any one of the aspects 7 to 9, the plural hot-cathode tubes are arranged parallel with each other in such a manner that thickness increasing directions of phosphor layers of the respective hot-cathode tubes are opposite to each other.

The above configurations make it possible to provide a compact and inexpensive ink-jet recording apparatus which is high in productivity because of high light intensity and can perform recording on various recording media.

DESCRIPTION OF SYMBOLS

Figure 1A:
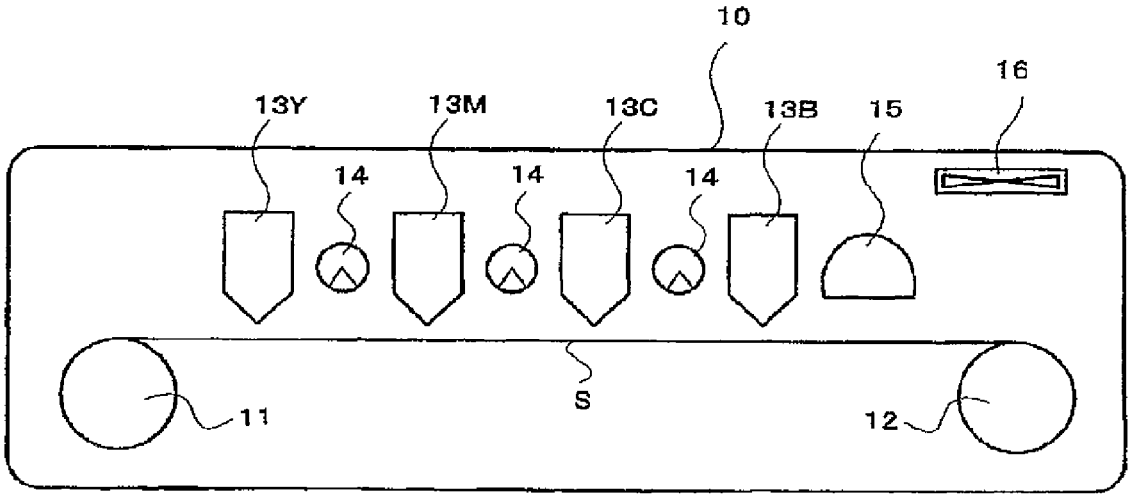
FIG. 1A is a conceptual diagram of an ink-jet recording apparatus according to a first embodiment of the present invention.

10': Single-pass ink-jet recording apparatus according to the invention
11: Recording medium roll
12: Take-up roll
13: Full-line ink-jet head
14: Aperture-type hot-cathode tube
14-1: First aperture-type hot-cathode tube
14-2: Second aperture-type hot-cathode tube
15: Metal halide lamp
16: Cooling fan
S: Recording medium
10': Single-pass ink-jet recording apparatus according to the invention
11: Recording medium roll
12: Take-up roll
13: Full-line ink-jet head
14: Aperture-type hot-cathode tube
L1: First aperture-type hot-cathode tube
L2: Second aperture-type hot-cathode tube
15: Metal halide lamp
16: Cooling fan
S: Recording medium

DETAILED DESCRIPTION OF THE INVENTION

Ink-jet recording apparatus according to embodiments of the present invention will be hereinafter described.

Embodiment 1

Figure 1B:
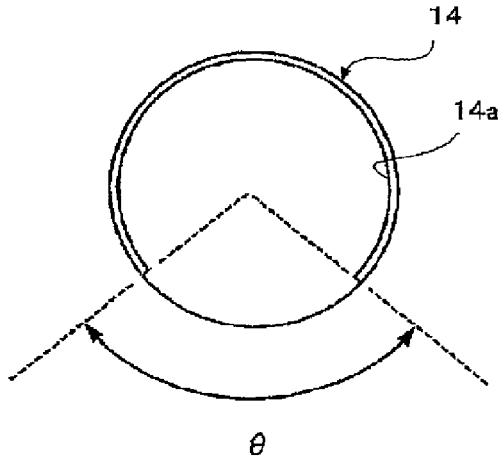
FIG. 1B is a sectional view of each aperture-type hot-cathode tube used in the ink-jet recording apparatus of FIG. 1A.

FIG. 1A is a conceptual diagram of an ink-jet recording apparatus according to a first embodiment of the invention, and FIG. 1B is a sectional view of each aperture-type hot-cathode tube used in the ink-jet recording apparatus of FIG. 1A.

In FIGS. 1A and 1B, reference numeral 10 denotes a single-pass ink-jet recording apparatus according to the first embodiment; 11, a recording medium roll; 12, a take-up roll; 13, full-line ink-jet heads; 14, active-energy-ray-setting lamps which are aperture-type hot-cathode tubes (described later); 15, a metal halide lamp; and 16, a cooling fan.

In the single-pass ink-jet recording apparatus 10, a recording medium S is pulled out of the recording medium roll 11 which is a roll-wound recording medium, subjected to a repetition of recording and fixing of each color, and taken up on the take-up roll 12. First, a desired image of a Y (yellow)-color ultraviolet-setting ink is recorded on the recording medium S as it is transported under a Y-color full-line ink-jet head 13Y in which a large number of ink-jet nozzles are arranged in the width direction (i.e., in the direction perpendicular to the paper surface of FIG. 1A) of the recording medium S. Immediately thereafter, the Y-color ink that has been discharged and placed on the recording medium S is pinned receiving an active energy ray as the recording medium S passes under the aperture-type hot-cathode tube 14.

Then, a desired image of an M (magenta)-color ultraviolet-setting ink is recorded on the recording medium S as it is transported under an M-color full-line ink-jet head 13M in which a large number of ink-jet nozzles are arranged in the width direction of the recording medium S. Immediately thereafter, the M-color ink that has been discharged and placed on the recording medium S is pinned receiving an active energy ray as the recording medium S passes under the aperture-type hot-cathode tube 14.

Then, a desired image of a C (cyan)-color ultraviolet-setting ink is recorded on The recording medium S as it is transported under a C-color full-line ink-jet head 13C in which a large number of ink-jet nozzles are arranged in the width direction of the recording medium S. Immediately thereafter, the C-color ink that has been discharged and placed on the recording medium S is pinned receiving an active energy ray as the recording medium S passes under the aperture-type hot-cathode tube 14.

Finally, a desired image of a B (black)-color ultraviolet-setting ink is recorded on the recording medium S as it is transported under a B-color full-line ink-jet head 13B in which a large number of ink-jet nozzles are arranged in the width direction of the recording medium S. Immediately thereafter, the B-color ink that has been discharged and placed on the recording medium S is illuminated uniformly as the recording medium S passes under the metal halide lamp 15 which is high in light intensity. And the inks of the four colors are fixed receiving the active energy ray. Four-color-ink recording is thus performed.

The aperture-type hot-cathode tube 14 will be described below. The aperture-type hot-cathode tube 14 is configured in such a manner that the inner surface of the glass tube of a hot-cathode tube is formed with a straight aperture where neither a phosphor nor a reflection coating (provided when necessary) is applied so that light is emitted in a concentrated manner and high output power is obtained.

FIG. 1B is a sectional view of the aperture-type hot-cathode tube 14. As shown in FIG. 1B, a phosphor 14*a* (and, when necessary, a reflection coating (see FIG. 8B)) is applied to the inner surface the glass tube of the aperture-type hot-cathode tube 14 except a bottom portion (as viewed in FIG. 1B) having an angle θ and extending parallel with the tube axis.

It is preferable that the central angle (aperture angle) θ of the uncoated portion in the cross-section taken perpendicularly to the tube axis be in a range of 45° to 180°. If the central angle θ is smaller than this range, the light illumination range is so narrow that a recording medium S passes under the hot-cathode tube 14 without receiving sufficient optical energy for pining. Conversely, if the central angle θ is larger than this range, the light illumination range is too wide to attain a sufficient aperture effect.

As described above, by virtue of the use of the aperture-type hot-cathode tubes 14 which are high in output power and hence can increase the pinning speed, an ink-jet recording apparatus can be provided which is high in productivity and can perform recording on various recording media. Furthermore, since the aperture-type hot-cathode tubes 14 are much less expensive and more compact than conventionally used high-pressure mercury lamps, an ink-jet recording apparatus can be provided which is compact and inexpensive.

Embodiment 2

Figure 2A:
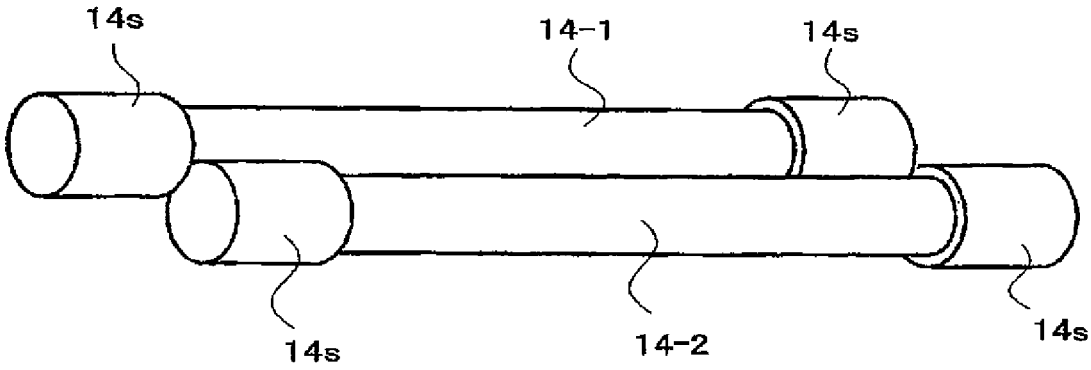
FIG. 2A is a perspective view of aperture-type hot-cathode tubes which constitute a light illumination unit according to a second embodiment of the invention.
Figure 2B:
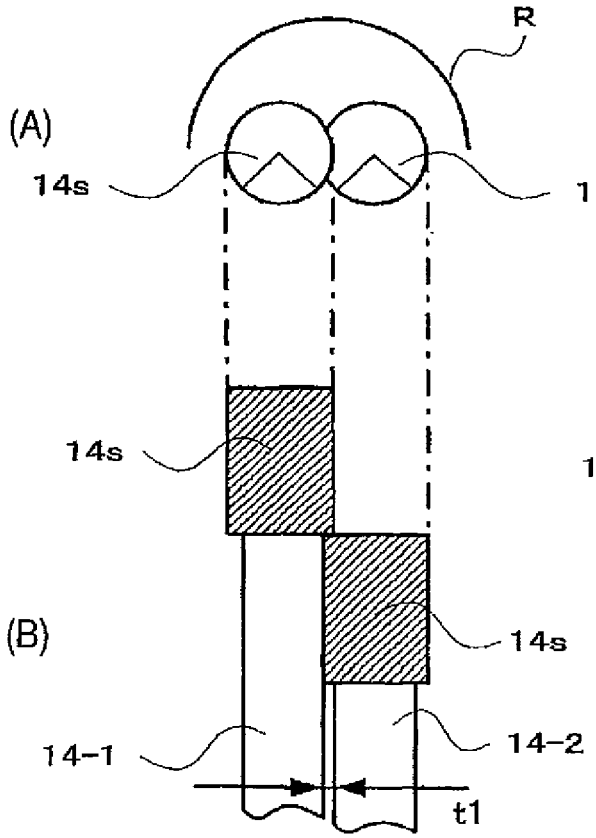
FIG. 2B is a front view (A) of the aperture-type hot-cathode tubes of FIG. 2A and a plan view (B) of their end portions.
Figure 2C:
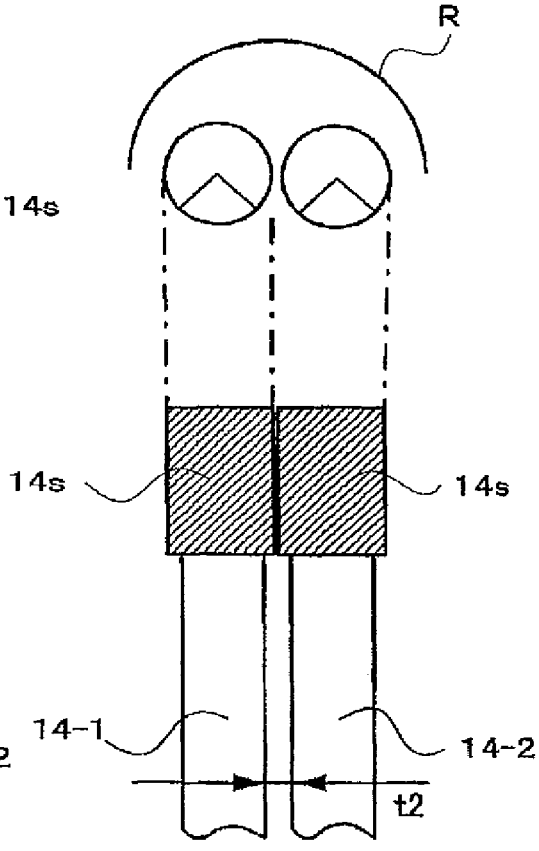
FIG. 2C is a front view (A) of aperture-type hot-cathode tubes which are arranged in an ordinary manner and a plan view (B) of their end portions.

FIG. 2A is a perspective view of aperture-type hot-cathode tubes which constitute a light illumination unit according to a second embodiment of the invention. FIG. 2B is a front view (A) of the aperture-type hot-cathode tubes of FIG. 2A and a plan view (B) of their end portions. FIG. 2C is a front view (A) of aperture-type hot-cathode tubes which are arranged in an ordinary manner and a plan view (B) of their end portions.

The second embodiment is such that two aperture-type hot-cathode tubes are arranged in a single plane. In FIGS. 2A-2C, reference symbols 14-1 and 14-2 denote first and second aperture-type hot-cathode tubes, respectively, and symbol 14*s* denotes socket portions of the respective aperture-type hot-cathode tubes 14-1 and 14-2. The socket portions 14*s* are larger in diameter than the glass portions. Therefore, if as shown in FIG. 2C the socket portions 14*s* are arranged side by side so as to be in contact with each other, a large gap t2 is formed between the glass tubes, so that unevenness occurs in the light intensity profile in the transport direction and the light illumination unit becomes long in the transport direction.

In contrast, where as shown in FIGS. 2A and 2B the socket portions 14*s* are arranged in such a manner that they are deviated from each other in the longitudinal direction and the socket portion 14*s* of one aperture-type hot-cathode tube is in contact with the glass tube of the other (in FIGS. 2A and 2B, the socket portion 14*s* of the aperture-type hot-cathode tube 14-2 is in contact with the glass tube of the aperture-type hot-cathode tube 14-1), the glass tubes have a small gap t1, whereby the degree of unevenness of the light intensity profile in the transport direction is lowered and the light illumination unit is shortened in the transport direction.

The light intensity of the light source can be kept constant by examining, in advance, a relationship between the light intensity at a portion of a reflector R that does not affect the light illumination and the light intensity on a recording medium S, installing a light intensity detecting optical sensor at that portion of the reflector R, and feeding back a light intensity signal produced by the optical sensor to inverters that are power sources for the respective hot-cathode tubes 14-1 and 14-2. More specifically, the light intensity of the light source can be kept constant by determining actual light intensity on a recording medium S from the above-mentioned relationship on the basis of a light intensity signal produced by the optical sensor and increasing (or decreasing) the outputs of the inverters if the actual light intensity is lower (or higher) than prescribed light intensity.

Embodiment 3

Figure 3A:
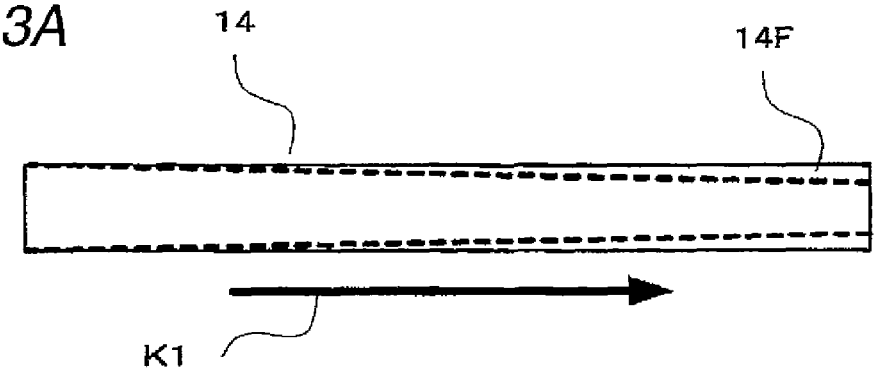
FIG. 3A is a sectional view, taken along its axis, of the glass tube of each aperture-type hot-cathode tube to which a third embodiment of the invention is directed.
Figure 3B:
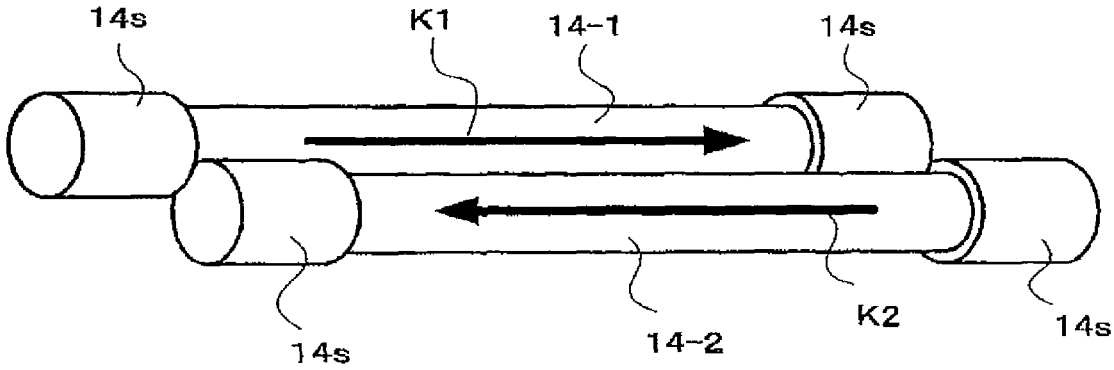
FIG. 3B is a perspective view of aperture-type hot-cathode tubes.
Figure 3C:
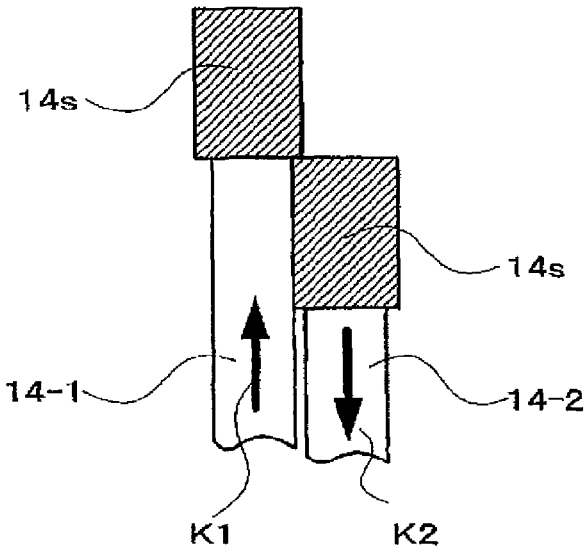
FIG. 3C is a plan view of end portions of the aperture-type hot-cathode tubes of FIG. 3B.

FIG. 3A is a sectional view, taken along its axis, of the glass tube of each aperture-type hot-cathode tube to which a third embodiment of the invention is directed. FIG. 3B is a perspective view of aperture-type hot-cathode tubes. FIG. 3C is a plan view of end portions of the aperture-type hot-cathode tubes of FIG. 3B.

Although the third embodiment is described on the basis of the second embodiment, it does not mean that the third embodiment can be applied to only the second embodiment. As shown in FIG. 3A, the inner surface of the glass tube of the aperture-type hot-cathode tube 14 is coated with a phosphor 14F. Because of a manufacturing method employed, the thickness of the phosphor 14F coating layer tends to increase from one end to the other as indicated by arrow K1 in FIG. 3A. (This is considered due to a manufacturing method that the glass tube is immersed vertically in a phosphor liquid and then lifted up in the vertical direction. Since the phosphor liquid on the glass tube descends due to gravity, the thickness of the phosphor layer increases as the position goes down.) This tendency cannot be avoided. Since the thickness of the phosphor 14F coating layer is not uniform, naturally the intensity of emitted light has a corresponding profile.

The third embodiment is intended to compensate for the above manufacture-related problem of the aperture-type hot-cathode tube 14 and is characterized as follows. As shown in FIG. 3B, in addition to the feature that two aperture-type hot-cathode tubes L1 and L2 are arranged side by side to so as to be deviated from each other in the longitudinal direction according to the second embodiment, the aperture-type hot-cathode tubes 14-1 and 14-2 are arranged so that the coating layer thickness increasing directions K1 and K2 of the respective aperture-type hot-cathode tubes 14-1 and 14-2 are opposite to each other. As a result, the light intensity profiles of the aperture-type hot-cathode tubes 14-1 and 14-2 compensate each other to provide a uniform light intensity profile as a whole. A light source suitable for the pinning can thus be obtained.

Embodiment 4

Figure 4A:
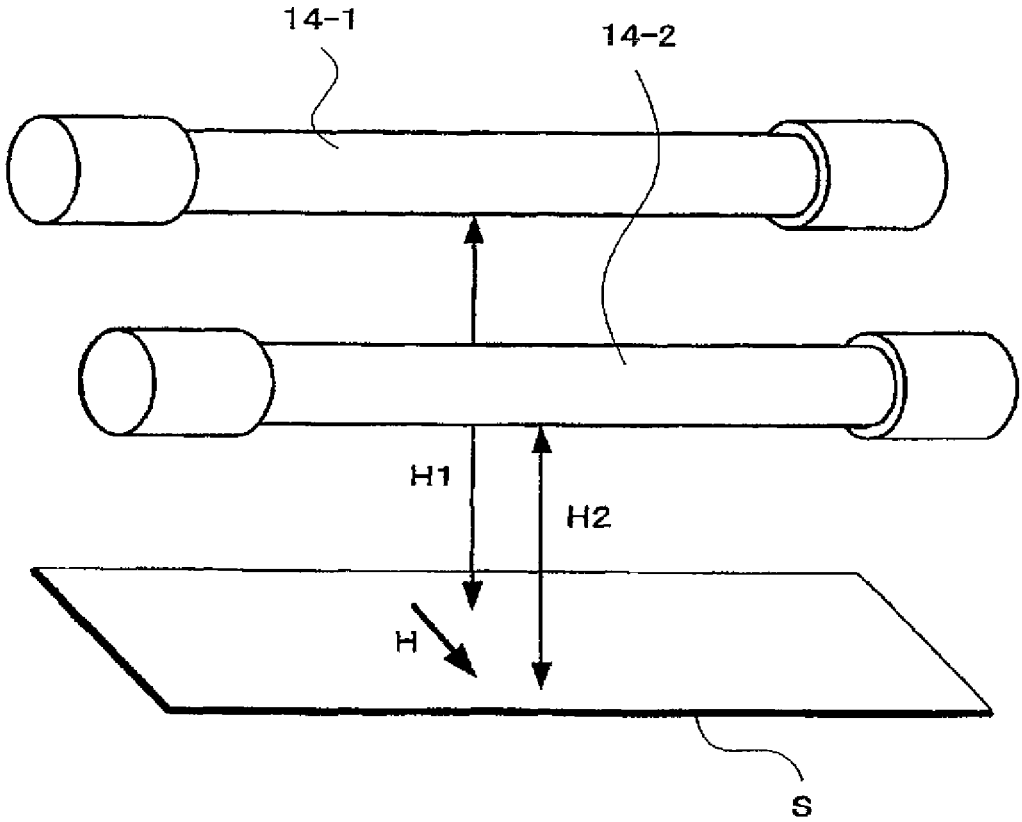
FIG. 4A is a perspective view showing the arrangement of two aperture-type hot-cathode tubes according to a fourth embodiment of the invention.
Figure 4B:
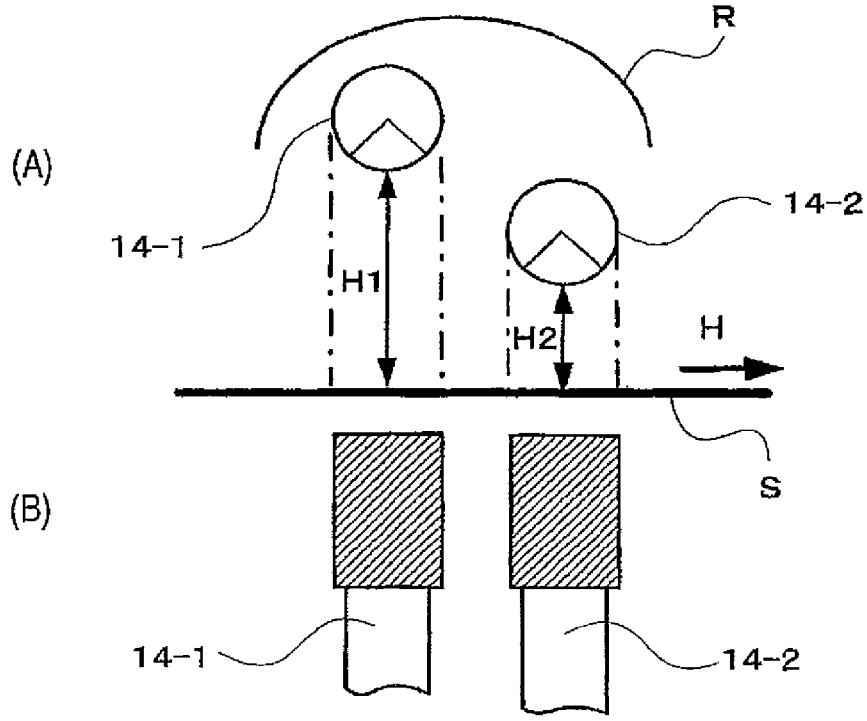
FIG. 4B is a front view (A) of the aperture-type hot-cathode tubes of FIG. 4A and a plan view (B) of their end portions.

FIG. 4A is a perspective view showing the arrangement of two aperture-type hot-cathode tubes according to a fourth embodiment of the invention. FIG. 4B is a front view (A) of the aperture-type hot-cathode tubes of FIG. 4A and a plan view (B) of their end portions.

The fourth embodiment is characterized in that, as shown in FIGS. 4A and 4B, the vertical heights H1 and H2, from a recording medium S, of the respective aperture-type hot-cathode tubes 14-1 and 14-2 are different from each other (H1>H2). The recording sheet S is transported in the direction of arrow H. That is, first an ink on the recording sheet S is fixed weakly by light coming from the distant hot-cathode tube 14-1, and then fixed further by light coming from the near hot-cathode tube 14-2. This prevents the ink from being heated rapidly and thereby prevents thermal distortion. Therefore, the pinning can be performed satisfactorily.

As a modification of the fourth embodiment, instead of setting the distances different from each other, the light intensities of two aperture-type hot-cathode tubes may be set different from each other (their distances are set the same). The aperture-type hot-cathode tube having lower light intensity is disposed upstream.

Embodiment 5

Figure 5A:
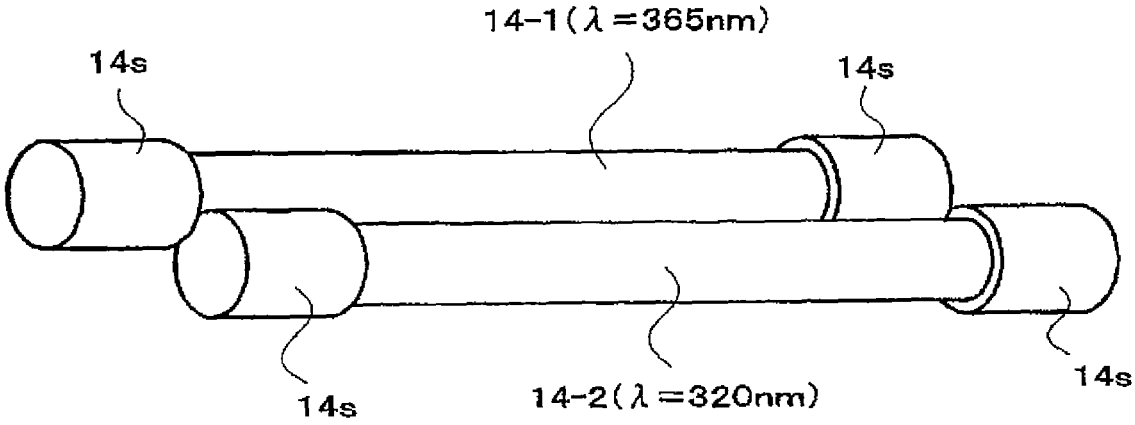
FIG. 5A is a perspective view of two aperture-type hot-cathode tubes according to a fifth embodiment of the invention.
Figure 5B:
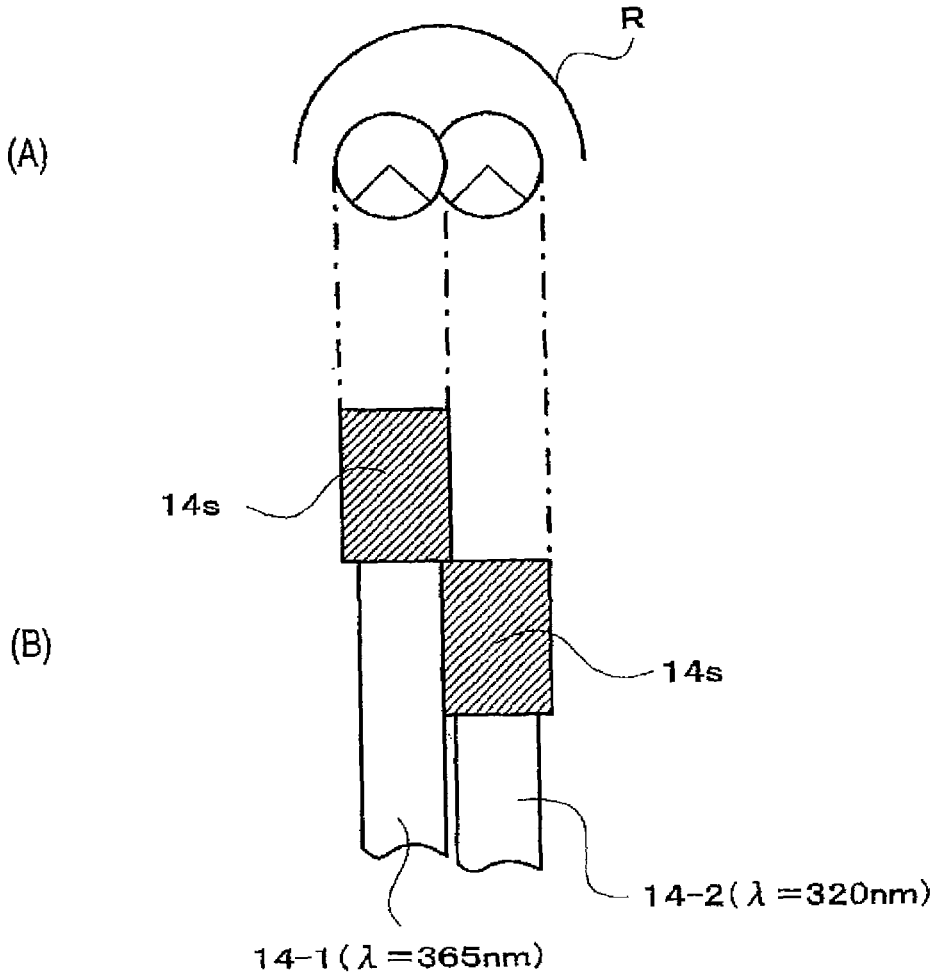
FIG. 5B is a front view (A) of the aperture-type hot-cathode tubes of FIG. 5A and a plan view (B) of their end portions.
Figure 6:
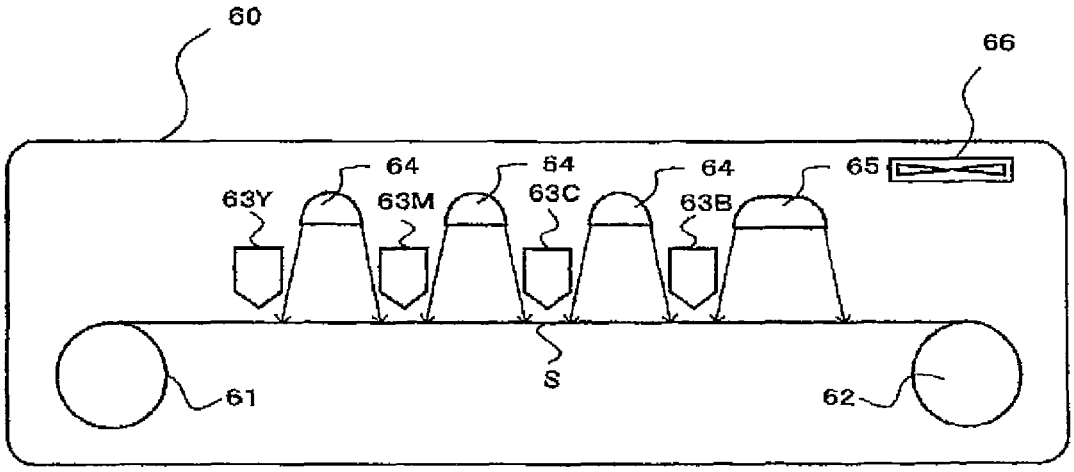
FIG. 6 shows a single-pass ink-jet recording apparatus disclosed in JP-A-2004-314586.
Figure 7:
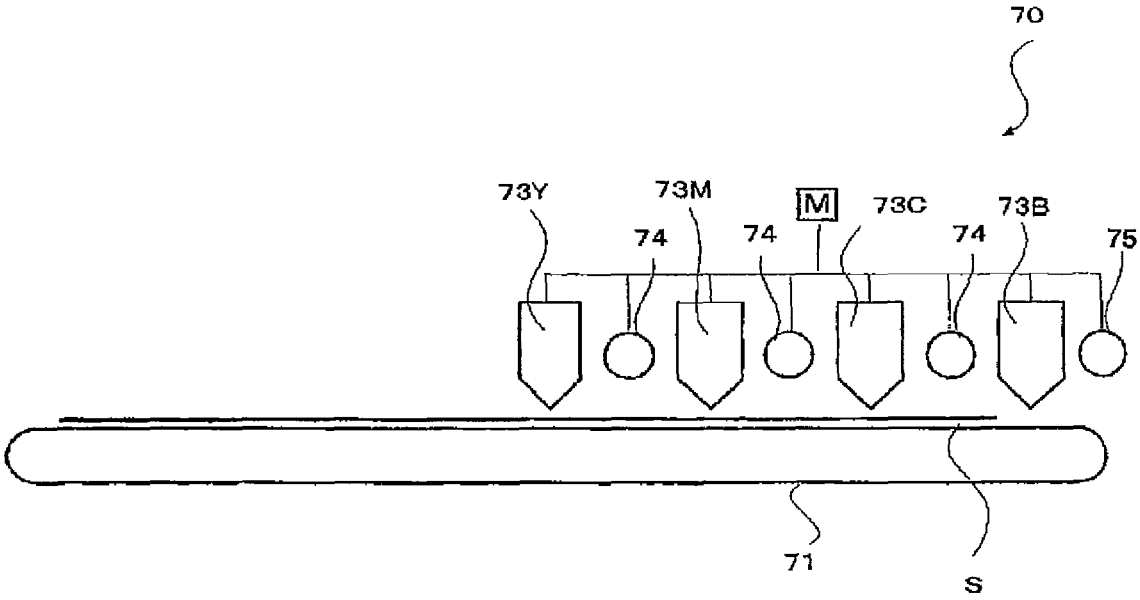
FIG. 7 shows an ink-jet recording apparatus disclosed in JP-A-2004-237602 which uses inexpensive hot cathode fluorescent tubes.

FIG. 5A is a perspective view of two aperture-type hot-cathode tubes according to a fifth embodiment of the invention. FIG. 5B is a front view (A) of the aperture-type hot-cathode tubes of FIG. 5A and a plan view (B) of their end portions.

The fifth embodiment is characterized in that the wavelength λ of light emitted from an aperture-type hot-cathode tube 14-1 is different from that of light emitted from an aperture-type hot-cathode tube 14-2 and the aperture-type hot-cathode tubes 14-1 and 14-2 are arranged side by side according to the second embodiment. For example, the wavelength λ of the first aperture-type hot-cathode tube 14-1 is 365 nm and that of the second aperture-type hot-cathode tube 14-2 is 320 nm.

Shorter-wavelength light (λ=320 nm) is less apt to reach the inside of ink and hence contributes to setting of a surface portion of the ink. On the other hand, longer-wavelength light (λ=365 nm) is apt to reach the inside of the ink and hence mainly takes charge of setting of an inside portion of the ink. In this manner, the fifth embodiment makes it possible to set ink uniformly in its thickness direction.

Embodiment 6

A case that two aperture-type hot-cathode tubes are used in each light illumination unit will be described below.

Figure 8A:
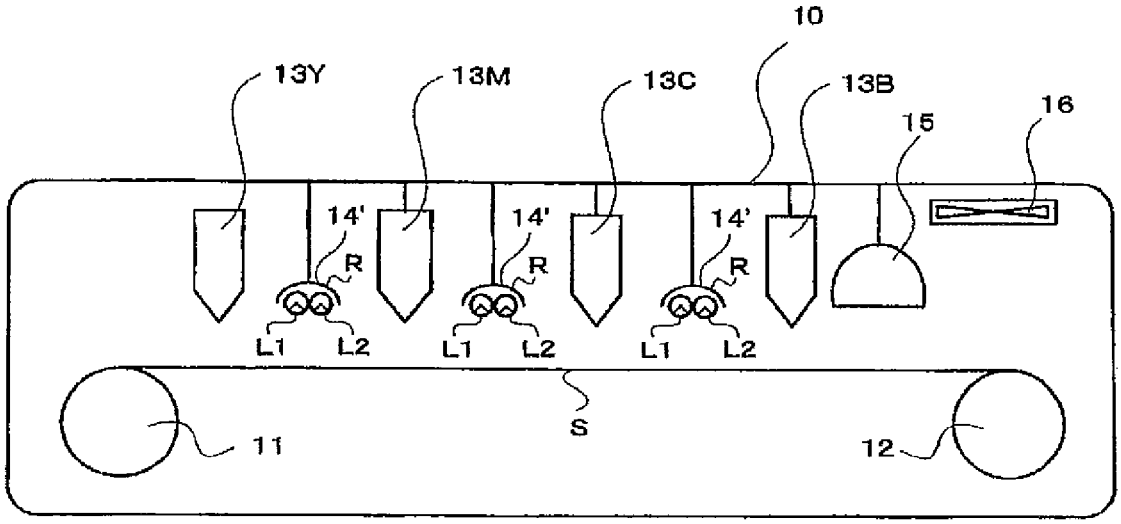
FIG. 8A is a conceptual diagram of an ink-jet recording apparatus according to a sixth embodiment of the invention.
Figure 8B:
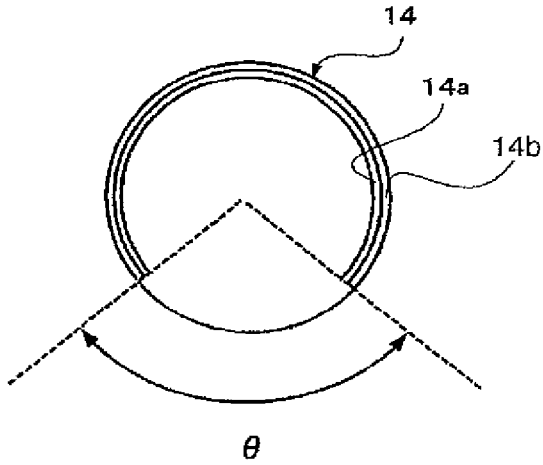
FIG. 8B is a sectional view of each aperture-type hot-cathode tube used in the ink-jet recording apparatus of FIG. 8B.

FIG. 8A is a conceptual diagram of an ink-jet recording apparatus according to a sixth embodiment of the invention. FIG. 8B is a sectional view of each aperture-type hot-cathode tube used in the ink-jet recording apparatus of FIG. 8A.

In FIGS. 8A and 8B, reference numeral 10' denotes a single-pass ink-jet recording apparatus; 11, a recording medium roll; 12, a take-up roll; 13, a full-line ink-jet heads; 14', active-energy-ray-setting lamp units (aperture-type hot-cathode tube units); 15, a metal halide lamp; and 16, a cooling fan.

In the single-pass ink-jet recording apparatus 10', a recording medium S is pulled out of the recording medium roll 11 which is a roll-wound recording medium, subjected to a repetition of recording and fixing of each color, and taken up on the take-up roll 12. First, a desired image of a Y (yellow)-color ultraviolet-setting ink is recorded on the recording medium S as it is transported under a Y-color full-line ink-jet head 13Y in which a large number of ink-jet nozzles are arranged in the width direction (i.e., in the direction perpendicular to the paper surface of FIG. 8A) of the recording medium S. Immediately thereafter, the Y-color ink that has been discharged and placed on the recording medium S is pinned (half set) receiving an active energy ray as the recording medium S passes under the aperture-type hot-cathode tube unit 14'.

Then, a desired image of an M (magenta)-color ultraviolet-setting ink is recorded on the recording medium S as it is transported under an M-color full-line ink-jet head 13M in which a large number of ink-jet nozzles are arranged in the width direction of the recording medium S. Immediately thereafter, the M-color ink that has been discharged and placed on the recording medium S is pinned (half set) receiving an active energy ray as the recording medium S passes under the aperture-type hot-cathode tube unit 14'.

Then, a desired image of a C (cyan)-color ultraviolet-setting ink is recorded on the recording medium S as it is transported under a C-color full-line ink-jet head 13C in which a large number of ink-jet nozzles are arranged in the width direction of the recording medium S. Immediately thereafter, the C-color ink that has been discharged and placed on the recording medium S is pinned (half set) receiving an active energy ray as the recording medium S passes under the aperture-type hot-cathode tube unit 14'.

Finally, a desired image of a B (black)-color ultraviolet-setting ink is recorded on the recording medium S as it is transported under a B-color full-line ink-jet head 13B in which a large number of ink-jet nozzles are arranged in the width direction of the recording medium S. Immediately thereafter, the B-color ink that has been discharged and placed on the recording medium S is illuminated uniformly as the recording medium S passes under the metal halide lamp 15 which is high in light intensity. And the inks of the four colors are fixed receiving the active energy ray. Four-color-ink recording is thus performed.

The structure of the aperture-type hot-cathode tube 14 will be described below with reference to FIG. 8B. The aperture-type hot-cathode tube 14 is configured in such a manner that the inner surface of the glass tube of a hot-cathode tube is formed with a straight aperture where neither a phosphor nor a reflection coating (provided when necessary) is applied so that light is emitted in a concentrated manner and high output power is obtained.

FIG. 8B is a sectional view of the aperture-type hot-cathode tube 14. As shown in FIG. 8B, a phosphor 14*a* (and, when necessary, a reflection coating 14*b*) is applied to the inner surface the glass tube of the aperture-type hot-cathode tube 14 except a bottom portion (as viewed in FIG. 8B) having an angle θ and extending parallel with the tube axis.

It is preferable that the central angle (aperture angle) θ of the uncoated portion in the cross-section taken perpendicularly to the tube axis be in a range of 45° to 180°. If the central angle θ is smaller than this range, the light illumination range is so narrow that a recording medium S passes under the hot-cathode tube 14 without receiving sufficient optical energy for pinning. Conversely, if the central angle θ is larger than this range, the light illumination range is too wide to attain a sufficient aperture effect.

Figure 9A:
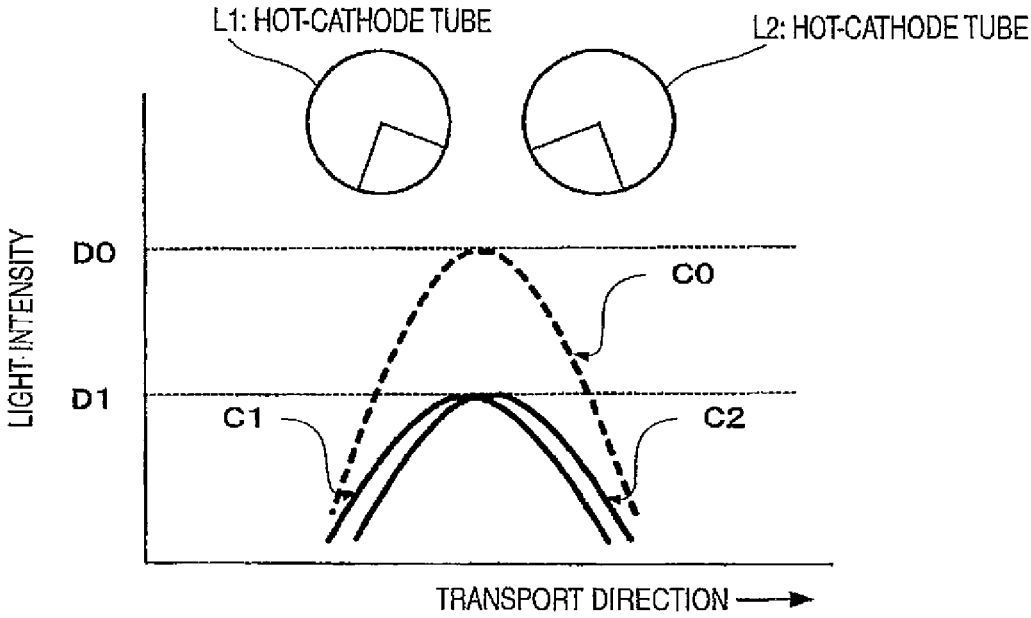
FIG. 9A shows the arrangement of two aperture-type hot-cathode tubes according to seventh to 10th embodiments of the invention.
Figure 9B:
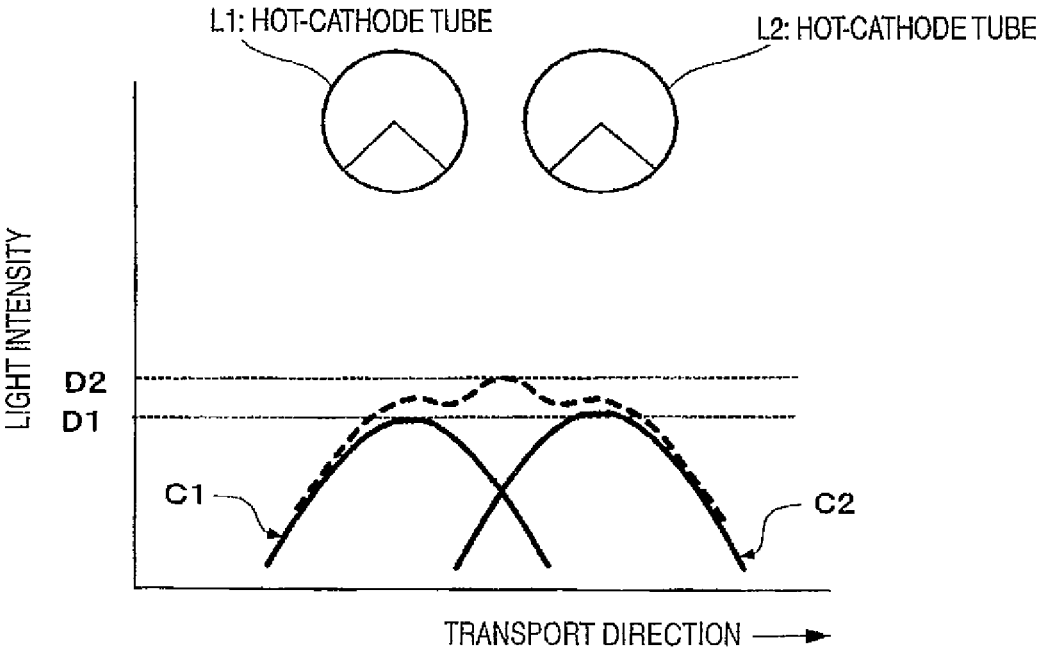
FIG. 9B shows the arrangement of two aperture-type hot-cathode tubes according to a sixth embodiment of the invention.

In the sixth embodiment, two aperture-type hot-cathode tubes L1 and L2 each having the above structure are arranged as shown in FIG. 9B.

FIG. 9A shows the arrangement of two aperture-type hot-cathode tubes according to seventh to 10th embodiments, and FIG. 9B shows the arrangement of two aperture-type hot-cathode tubes according to the sixth embodiment. As shown in FIG. 9B, the aperture-type hot-cathode tube L1 has a light intensity curve C1 in the recording medium transport direction and maximum light intensity D1. The aperture-type hot-cathode tube L2, which is disposed downstream of the aperture-type hot-cathode tube L1 in the recording medium transport direction, has a light intensity curve C2 in the recording medium transport direction and maximum light intensity D1.

In FIG. 9B, a broken line is a total (combined) light intensity curve of the light intensity curves C1 and C2 of the aperture-type hot-cathode tubes L1 and L2. Although maximum light intensity D2 is obtained, the total light intensity curve is broad in the recording medium transport direction and cannot produce an active energy ray having a sufficient power. The pinning speed cannot be set high and it is difficult to attain high productivity.

The seventh to 10th embodiments are intended to solve this problem. In the seventh to 10th embodiments, as shown in FIG. 9A, the aperture-type hot-cathode tube L1 is rotated so that its aperture is directed downstream in the transport direction and the aperture-type hot-cathode tube L2, which is disposed downstream of the aperture-type hot-cathode tube L1 in the transport direction, is rotated so that its aperture is directed upstream in the transport direction so that their maximum light intensities D1 are obtained at the same position.

With this measure, the maximum light intensity D0 of a total light intensity curve C0 is higher than the maximum light intensity D2 show in FIG. 9B. As a result, an active energy ray having a sufficient power can be applied to a recording medium S. The pinning speed can be set high and high productivity can be attained.

As for the manners of rotation of the aperture-type hot-cathode tubes L1 and L2, the only requirement is that their maximum light intensities D1 be obtained at the same position. Therefore, another arrangement is possible in which the aperture of the aperture-type hot-cathode tube L1 is directed right below and the aperture-type hot-cathode tube L2, which is disposed downstream of the aperture-type hot-cathode tube L1 in the transport direction, is rotated to a large extent so that its aperture is directed further upstream in the transport direction so that their maximum light intensities D1 are located at the same position which is close to the position of the head that is disposed upstream of the aperture-type hot-cathode tube L1. This makes it possible to further shorten the interval between the image drawing and the pinning and to thereby form an image having even higher quality.

As exemplified above, the position where the maximum light intensities D1 of the light intensity curves of the hot-cathode tubes L1 and L2 exist can be adjusted so as to be suitable for the ink type, the recording medium type, the environment including temperature and humidity, or the recording rate. To this end, it is appropriate to provide a mechanism for adjusting the rotation angles of the hot-cathode tubes L1 and L2 and to control the mechanism automatically by detecting a condition of the above parameter and calculating proper rotation angles.

Embodiment 7

Figure 10:
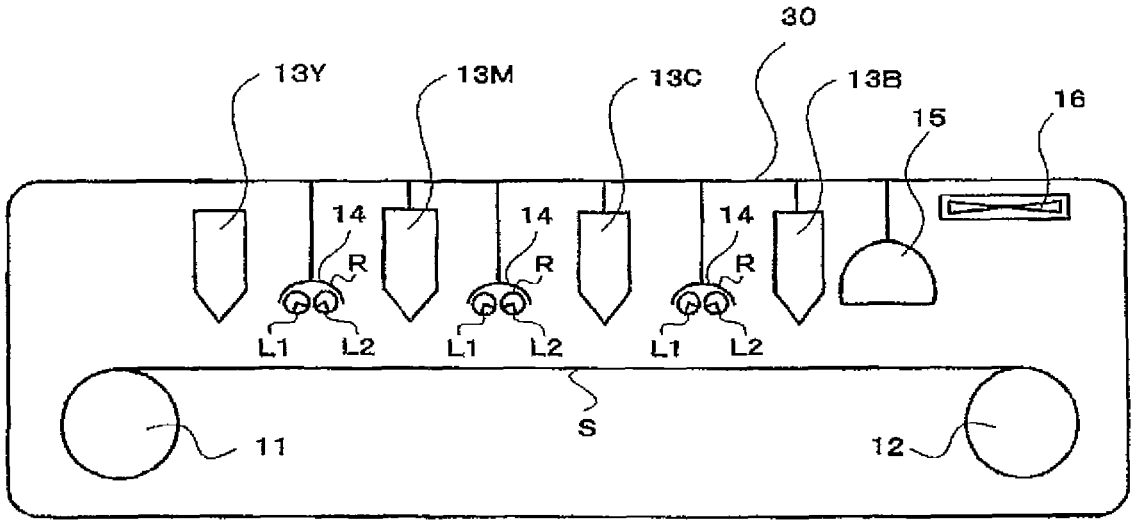
FIG. 10 is a conceptual diagram of an ink-jet recording apparatus according to the seventh embodiment of the invention.

FIG. 10 is a conceptual diagram of an ink-jet recording apparatus according to the seventh embodiment of the invention. The ink-jet recording apparatus of FIG. 10 is different from that of FIG. 8A in that whereas the two aperture-type hot-cathode tubes L1 and L2 of each active-energy-ray-setting lamp unit 14' shown in FIG. 8A are arranged as shown in FIG. 9B, those of each active-energy-ray-setting lamp unit 14' shown in FIG. 10 are arranged as shown in FIG. 9A.

In FIG. 10, reference numeral 30 denotes a single-pass ink-jet recording apparatus according to the seventh embodiment of the invention; 11, a recording medium roll; 12, a take-up roll; 13, full-line ink-jet heads; 14, active-energy-ray-setting lamps (aperture-type hot-cathode tubes L1 and L2); 15, a metal halide lamp; and 16, a cooling fan.

In the single-pass ink-jet recording apparatus 30, a recording medium S is pulled out of the recording medium roll 11 which is a roll-wound recording medium, subjected to a repetition of recording and fixing of each color, and taken up on the take-up roll 12. First, a desired image of a Y (yellow)-color ultraviolet-setting ink is recorded on the recording medium S as it is transported under a Y-color full-line ink-jet head 13Y in which a large number of ink-jet nozzles are arranged in the width direction (i.e., in the direction perpendicular to the paper surface of FIG. 10) of the recording medium S. Immediately thereafter, the Y-color ink that has been discharged and placed on the recording medium S is pinned (half set) receiving a sufficiently strong active energy ray as the recording medium S passes under the high-output-power aperture-type hot-cathode tube unit 14' according to the invention.

Then, a desired image of an M (magenta)-color ultraviolet-setting ink is recorded on the recording medium S as it is transported under an M-color full-line ink-jet head 13M in which a large number of ink-jet nozzles are arranged in the width direction of the recording medium S. Immediately thereafter, the M-color ink that has been discharged and placed on the recording medium S is pinned (half set) receiving a sufficiently strong active energy ray as the recording medium S passes under the high-output-power aperture-type hot-cathode tube unit 14' according to the invention.

Then, a desired image of a C (cyan)-color ultraviolet-setting ink is recorded on the recording medium S as it is transported under a C-color full-line ink-jet head 13C in which a large number of ink-jet nozzles are arranged in the width direction of the recording medium S. Immediately thereafter, the C-color ink that has been discharged and placed on the recording medium S is pinned (half set) receiving a sufficiently strong active energy ray as the recording medium S passes under the high-output-power aperture-type hot-cathode tube unit 14' according to the invention.

Finally, a desired image of a B (black)-color ultraviolet-setting ink is recorded on the recording medium S as it is transported under a B-color full-line ink-jet head 13B in which a large number of ink-jet nozzles are arranged in the width direction of the recording medium S. Immediately thereafter, the B-color ink that has been discharged and placed on the recording medium S is illuminated uniformly as the recording medium S passes under the metal halide lamp 15 which is high in light intensity. And the inks of the four colors are fixed receiving the active energy ray. Four-color-ink recording is thus performed.

As described above, in the seventh embodiment, the aperture-type hot-cathode tube L1 is rotated so that its aperture is directed downstream in the transport direction and the aperture-type hot-cathode tube L2, which is disposed downstream of the aperture-type hot-cathode tube L1 in the transport direction, is rotated so that its aperture is directed upstream in the transport direction so that their maximum light intensities D1 are obtained at the same position. As a result, the maximum light intensity D0 of the combined light intensity curve C0 is increased greatly and a strong active energy ray can be applied to a recording medium S. The pinning speed can be set high and high productivity can be attained.

Embodiment 8

Figure 11A:
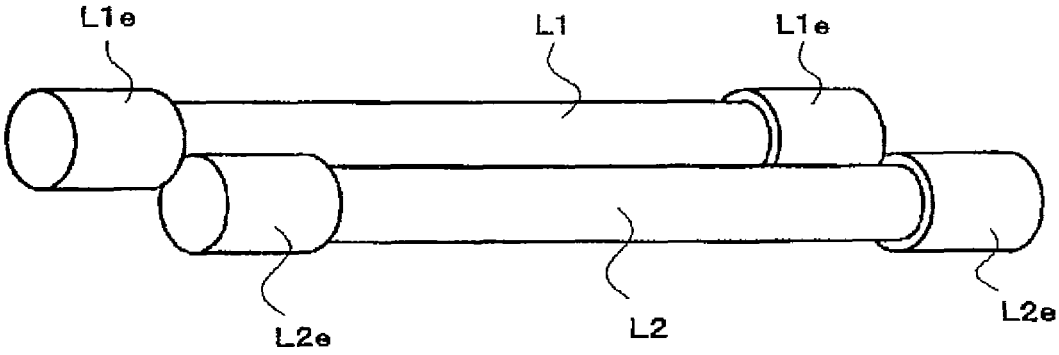
FIG. 11A is a perspective view of aperture-type hot-cathode tubes which constitute a light illumination unit according to the eighth embodiment of the invention.
Figure 11B:
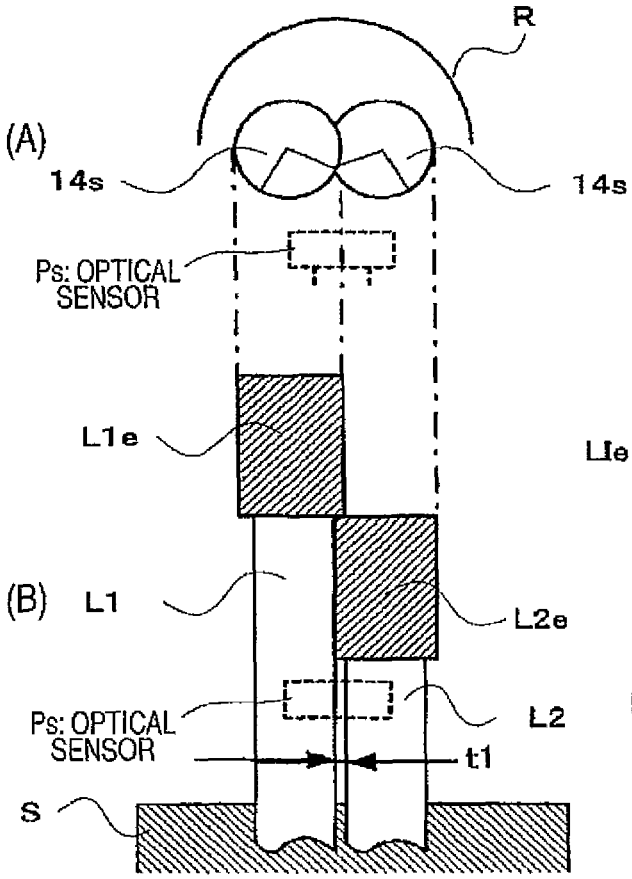
FIG. 11B is a front view (A) of the aperture-type hot-cathode tubes of FIG. 11A and a plan view (B) of their end portions.
Figure 11C:
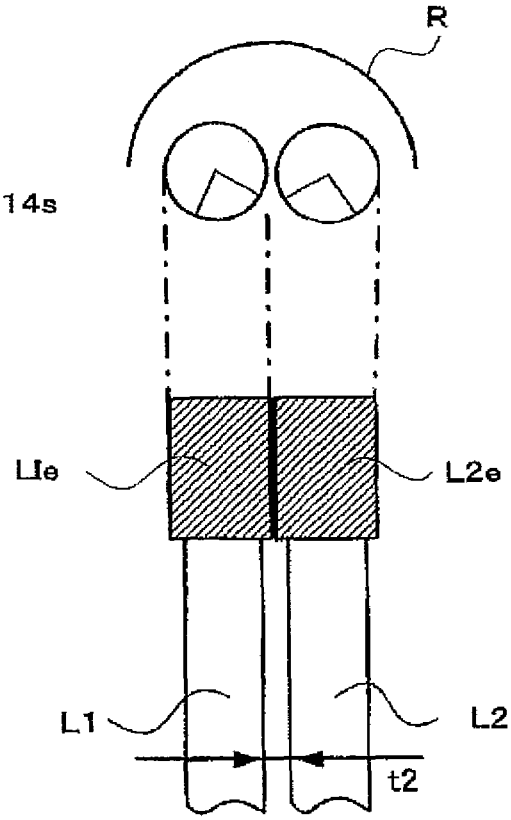
FIG. 11C is a front view (A) of aperture-type hot-cathode tubes having an arrangement that is a base of the arrangement of the eighth embodiment and a plan view (B) of their end portions.

FIG. 11A is a perspective view of aperture-type hot-cathode tubes which constitute a light illumination unit according to the eighth embodiment of the invention. FIG. 11B is a front view (A) of the aperture-type hot-cathode tubes of FIG. 11A and a plan view (B) of their end portions. FIG. 11C is a front view (A) of aperture-type hot-cathode tubes having an arrangement that is a base of the arrangement of the eighth embodiment and a plan view (B) of their end portions.

The eighth embodiment is such that two aperture-type hot-cathode tubes are arranged in a single plane. In FIGS. 11A-11C, reference symbols L1 and L2 denote first and second aperture-type hot-cathode tubes, respectively, and symbol Le denotes socket portions of the respective aperture-type hot-cathode tubes L1 and L2 (the socket portions of the aperture-type hot-cathode tube L1 are denoted by L1*e* and the socket portions of the aperture-type hot-cathode tube L2 are denoted by L2*e*).

The socket portions Le are larger in diameter than the glass portions. Therefore, if as shown in FIG. 11C the socket portions Le are arranged side by side so as to be in contact with each other, a large gap t2 is formed between the glass tubes, so that unevenness occurs in the light intensity profile in the transport direction and the light illumination unit becomes long in the transport direction.

In contrast, where as shown in FIGS. 11A and 11B the socket portions L1*e* and L2*e* are arranged in such a manner that they are deviated from each other in the longitudinal direction by their length and the socket portion Le of one aperture-type hot-cathode tube is in contact with the glass tube of the other (in FIGS. 11A and 11B, the socket portion L2*e* of the second aperture-type hot-cathode tube L2 is in contact with the glass tube of the first aperture-type hot-cathode tube L1), the glass tubes have a small gap t1, whereby the degree of unevenness of the light intensity profile in the transport direction is lowered and the light illumination unit is shortened in the transport direction.

Naturally, the concept of the seventh embodiment is also applied to the eighth embodiment. That is, the aperture-type hot-cathode tube L1 is rotated so that its aperture is directed downstream in the transport direction and the aperture-type hot-cathode tube L2, which is disposed downstream of the aperture-type hot-cathode tube L1 in the transport direction, is rotated so that its aperture is directed upstream in the transport direction so that their maximum light intensities D1 are obtained at the same position. As a result the maximum light intensity D0 of the combined light intensity curve C0 is increased greatly and a strong active energy ray can be applied to a recording medium S. The pinning speed can be set high and high productivity can be attained.

Furthermore, as in the case of the seventh embodiment, the position where the maximum light intensities D1 of the light intensity curves of the hot-cathode tubes L1 and L2 exist can be adjusted so as to be suitable for the ink type, the recording medium type, the environment including temperature and humidity, or the recording rate.

Embodiment 9

Figure 12A:
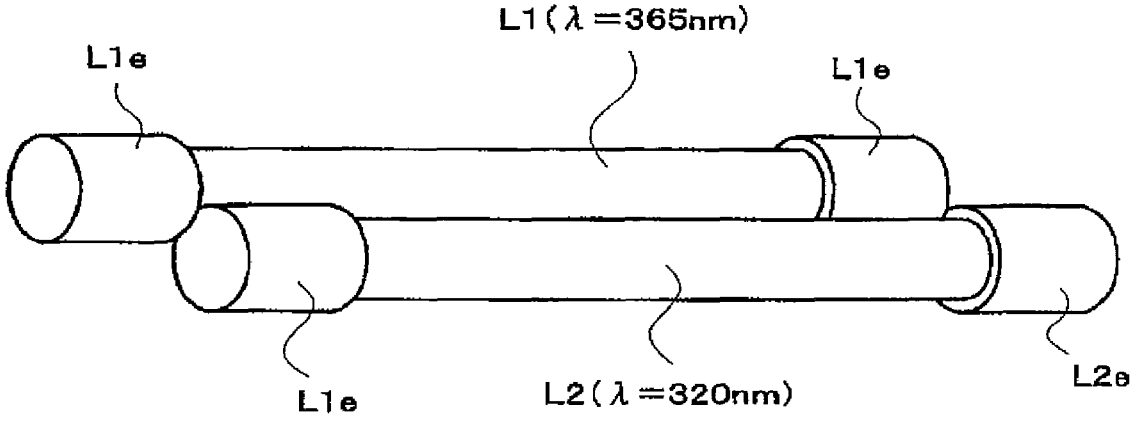
FIG. 12A is a perspective view of two aperture-type hot-cathode tubes according to the ninth embodiment of the invention.
Figure 12B:
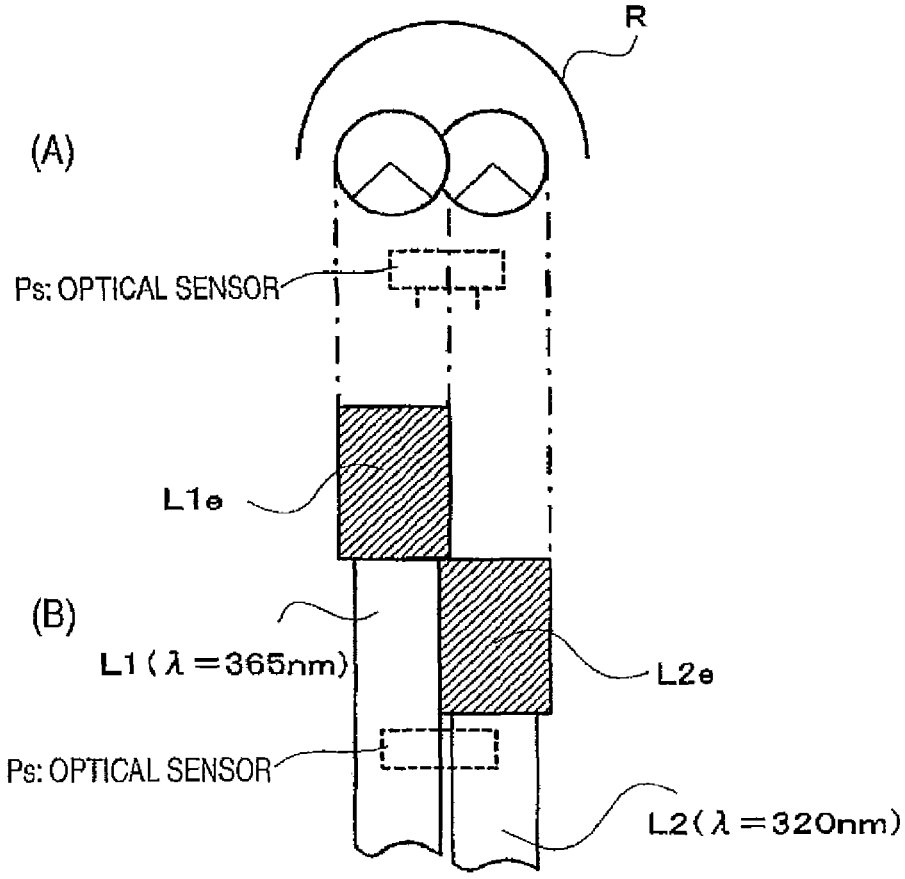
FIG. 12B is a front view (A) of the aperture-type hot-cathode tubes of FIG. 12A and a plan view (B) of their end portions.

FIG. 12A is a perspective view of two aperture-type hot-cathode tubes according to the ninth embodiment of the invention. FIG. 12B is a front view (A) of the aperture-type hot-cathode tubes of FIG. 12A and a plan view (B) of their end portions.

The ninth embodiment is characterized in that the wavelength λ of light emitted from an aperture-type hot-cathode tube L1 is different from that of light emitted from an aperture-type hot-cathode tube L2 and the aperture-type hot-cathode tubes L1 and L2 are arranged side by side according to the eighth embodiment (FIGS. 11A and 11B). For example, the wavelength λ of the first aperture-type hot-cathode tube L1 is 365 nm and that of the second aperture-type hot-cathode tube L2 is 320 nm.

Shorter-wavelength light (λ=320 nm) is less apt to reach the inside of ink and hence contributes to setting of a surface portion of the ink. On the other hand, longer-wavelength light (λ=365 nm) is apt to reach the inside of the ink and hence mainly takes charge of setting of an inside portion of the ink. In this manner, the ninth embodiment makes it possible to set ink uniformly in its thickness direction.

Naturally, the concept of the seventh embodiment is also applied to the ninth embodiment. That is, the aperture-type hot-cathode tube L1 is rotated so that its aperture is directed downstream in the transport direction and the aperture-type hot-cathode tube L2, which is disposed downstream of the aperture-type hot-cathode tube L1 in the transport direction, is rotated so that its aperture is directed upstream in the transport direction so that their maximum light intensities D1 are obtained at the same position. As a result the maximum light intensity D0 of a total light intensity curve C0 is increased greatly and a strong active energy ray can be applied to a recording medium S. The pinning speed can be set high and high productivity can be attained.

Furthermore, as in the case of the seventh embodiment, the position where the maximum light intensities D1 of the light intensity curves of the hot-cathode tubes L1 and L2 exist can be adjusted so as to be suitable for the ink type, the recording medium type, the environment including temperature and humidity, or the recording rate.

Even better performance is obtained because the concept of the eighth embodiment is also employed.

Embodiment 10

Figure 13A:
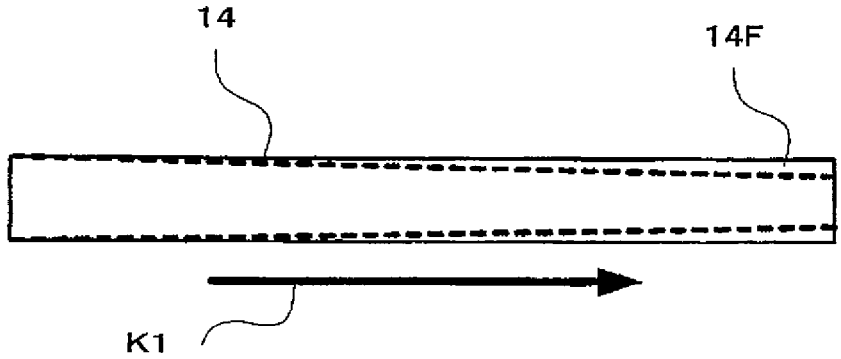
FIG. 13A is a sectional view, taken along its axis, of the glass tube of each aperture-type hot-cathode tube to which the 10th embodiment of the invention is directed.
Figure 13B:
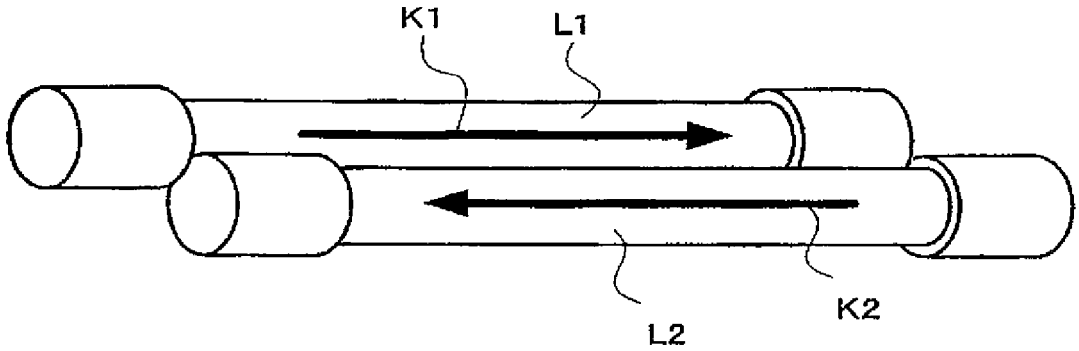
FIG. 13B is a perspective view of aperture-type hot-cathode tubes.
Figure 13C:
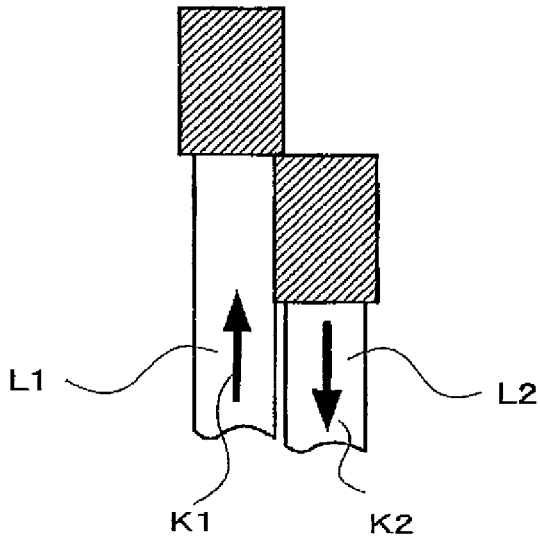
FIG. 13C is a plan view of end portions of the aperture-type hot-cathode tubes of FIG. 13B.

FIG. 13A is a sectional view, taken along its axis, of the glass tube of each aperture-type hot-cathode tube to which the 10th embodiment of the invention is directed. FIG. 13B is a perspective view of aperture-type hot-cathode tubes. FIG. 13C is a plan view of end portions of the aperture-type hot-cathode tubes of FIG. 13B.

As shown in FIG. 13A, the inner surface of the glass tube of the aperture-type hot-cathode tube 14 is coated with a phosphor 14F. Because of a manufacturing method employed, the thickness of the phosphor 14F coating layer tends to increase from one end to the other as indicated by arrow K1 in FIG. 13A. (This is considered due to a manufacturing method that the glass tube is immersed vertically in a phosphor liquid and then lifted up in the vertical direction. Since the phosphor liquid on the glass tube descends due to gravity, the thickness of the phosphor layer increases as the position goes down.) This tendency cannot be avoided. Since the thickness of the phosphor 14F coating layer is not uniform, naturally the intensity of emitted light has a corresponding profile.

The 10th embodiment is intended to compensate for the above manufacture-related problem of the aperture-type hot-cathode tube 14 and is characterized as follows. As shown in FIG. 13B, in addition to the features that two aperture-type hot-cathode tubes L1 and L2 are rotated so that their apertures are directed away from the vertical direction (seventh embodiment) and the two aperture-type hot-cathode tubes L1 and L2 are arranged side by side to so as to be somewhat deviated from each other in the longitudinal direction (eighth embodiment), the aperture-type hot-cathode tubes L1 and L2 are arranged so that the coating layer thickness increasing directions K1 and K2 of the respective aperture-type hot-cathode tubes L1 and L2 are opposite to each other.

As a result, the light intensity profiles of the aperture-type hot-cathode tubes L1 and L2 compensate each other to provide a uniform light intensity profile as a whole. A light source suitable for the pinning (half setting) can thus be obtained.

Figure 14A:
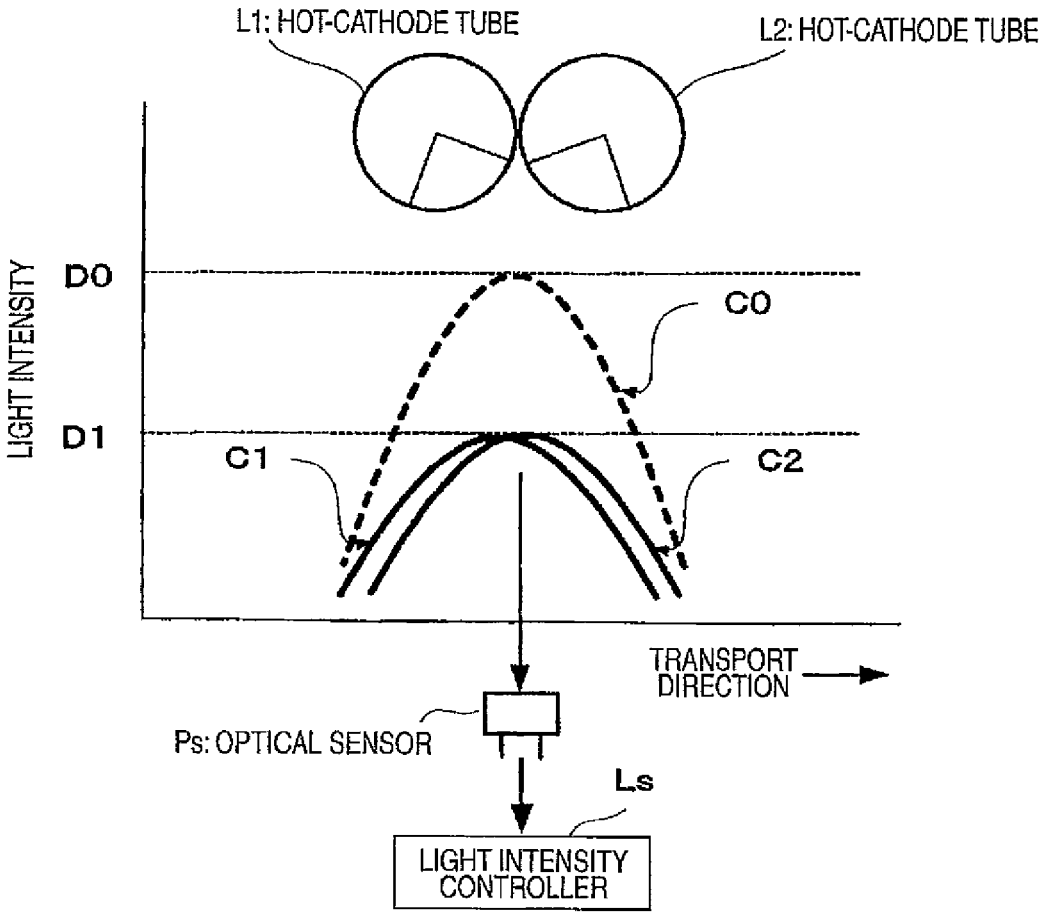
FIGS. 14A and 14B illustrate a method for controlling the light intensity of each aperture-type hot-cathode tube as well as an optical sensor used.

An optical sensor which is used for the light intensity control of the above-described aperture-type hot-cathode tubes L1 and L2 will be described below with reference to FIGS. 14A and 14B. Since an optical sensor Ps and a feedback control system are expensive, only one optical sensor Ps is disposed at a position of the maximum light intensity D0, that is, at the middle between the aperture-type hot-cathode tubes L1 and L2 (see FIG. 14A). In the longitudinal direction of the aperture-type hot-cathode tubes L1 and L2, as indicated by a broken line in FIG. 11B, the optical sensor Ps is disposed at a position that is located on the recording-medium-S-side of the aperture-type hot-cathode tubes L1 and L2 and is deviated from the end line, in the width direction, of a recording medium S. This prevents the optical sensor Ps from obstructing the pinning (half setting).

Figure 14B:
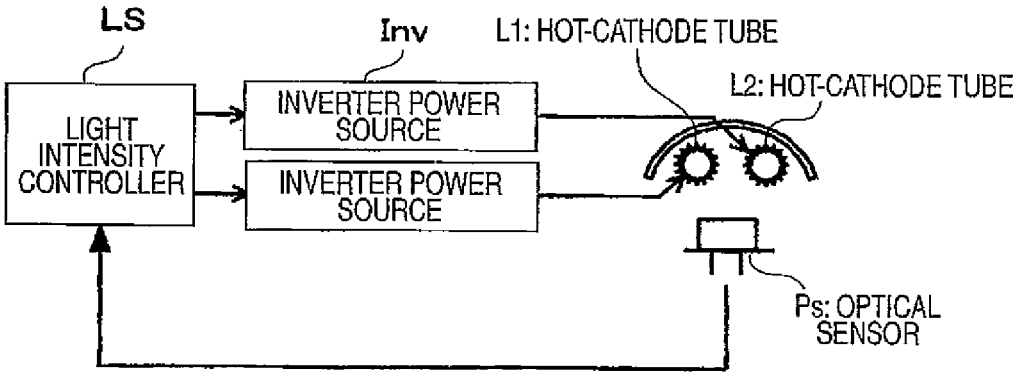

In FIG. 14B, reference symbol LS denotes a light intensity controller; Inv, inverter power sources; L1 and L2, the hot-cathode tubes; Ps, the optical sensor which is disposed between the hot-cathode tubes L1 and L2 (below the hot-cathode tubes L1 and L2).

Based on illuminance detected by the optical sensor Ps, the light intensity controller LS controls the output voltages that are supplied to the respective inverter power sources Inv. In response, the inverter power sources Inv supply optimum powers to the hot-cathode tubes L1 and L2. If the optical sensor Ps detects that the light intensity is too high, the light intensity controller LS controls the switching element in such a direction as to lower the output voltages for the inverter power sources Inv to thereby decrease the powers supplied from the inverter power sources Inv to the hot-cathode tubes L1 and L2. Conversely, if the optical sensor Ps detects that the light intensity is too low, the light intensity controller LS a control in such a direction as to increase the output voltages for the inverter power sources Inv to thereby increase the powers supplied from the inverter power sources Inv to the hot-cathode tubes L1 and L2. It is preferable to employ current control in controlling the powers supplied from the inverter power sources Inv to the hot-cathode tubes L1 and L2. The output powers of the hot-cathode tubes L1 and L2 can be kept stable by employing current control. Since the light emission efficiency of each of the hot-cathode tubes L1 and L2 depends on its tube temperature, it is even preferable to keep the tube temperature in a prescribed range using a temperature sensor, a cooling fan, etc. This allows the hot-cathode tubes L1 and L2 to exhibit even more stable light emission characteristics.

A good image can be produced by illuminating ink at optimum light intensity by detecting peak intensity D2 and feeding it back to the light intensity controller LS in the above-described manner.

As described above, the invention makes it possible to provide a compact and inexpensive ink-jet recording apparatus which is high in productivity because of a high fixing speed and can perform recording on various recording media.

It is particularly preferable that each ultraviolet-setting ink composition be such as to be set when irradiated with an activation energy ray.

The "active energy ray" as used in the present invention is not particularly limited as long as its irradiation can impart active energy ray capable of generating an initiation species in the ink composition, and widely includes α-ray, γ-ray, X-ray, ultraviolet ray, visible ray, electron beam and the like. Among these, in view of curing sensitivity and easy availability of the apparatus, ultraviolet ray and electron beam are preferred, and ultraviolet ray is more preferred. Accordingly, the ink composition for use in the present invention is preferably an ink composition which can be cured by the irradiation of ultraviolet ray.

In the ink-jet recording apparatus of the present invention, the peak wavelength of active energy ray varies depending on the absorption characteristics of the sensitizing dye in the ink composition but is suitably, for example, from 200 to 600 nm, preferably from 300 to 450 nm, more preferably from 350 to 450 nm. Also, the (a) electron transfer-type initiation system of the ink composition for use in the present invention exhibits sufficiently high sensitivity even for low-output active energy ray. Accordingly, the output of the active energy ray used as the irradiation active energy ray is suitably, for example, 2,000 mJ/cm$^2$ or less, preferably from 10 to 2,000 mJ/cm$^2$, more preferably from 20 to 1,000 mJ/cm$^2$, still more preferably from 50 to 800 mJ/cm$^2$. Also, the active energy ray is suitably irradiated at an exposure surface illuminance (a maximum illuminance on the recording medium surface) of, for example, from 10 to 2,000 mW/cm$^2$, preferably from 20 to 1,000 mW/cm$^2$.

Particularly, in the ink-jet recording apparatus of the present invention, the active energy ray is preferably irradiated from a light-emitting diode which can generate an active energy ray having an emission wavelength peak of 390 to 420 nm and giving a maximum illuminance of 10 to 1,000 mW/cm$^2$ on the recording medium surface.

Also, in the ink-jet recording apparatus of the present invention, the active energy ray suitably irradiates the ink composition ejected on a recording medium, for example, for 0.01 to 120 seconds, preferably from 0.1 to 90 seconds.

Furthermore, in the ink-jet recording apparatus of the present invention, it is preferred that the ink composition is heated to a fixed temperature and the time from the landing of ink composition on a recording medium to the irradiation of active energy ray is set to 0.01 to 0.5 seconds, preferably from 0.02 to 0.3 seconds, more preferably from 0.03 to 0.15 seconds. By virtue of controlling the time from the landing of ink composition on a recording medium to the irradiation of active energy ray to such a very short time, the ink composition landed can be prevented from bleeding before curing.

For obtaining a color image by using the ink-jet recording apparatus of the present invention, the colors are preferably superposed in the color value order from lower to higher. When superposed in such an order, the active energy ray can readily reach the ink in the lower part and this can be expected to yield good curing sensitivity, reduction of residual monomer, decrease of odor and enhancement of adhesive property. As for the irradiation of active energy ray, all colors may be ejected and en bloc exposed, but exposure is preferably performed every each color in view of accelerating the curing.

For example, each ink-jet head used in the invention is a piezoelectric ink-jet head capable of being driven so as to emit multi-size dots of 1 to 100 pl (preferably 1 to 30 pl) at a resolution of 320 dpi×320 dpi to 4,000 dpi×4,000 dpi, for example (preferably 400 dpi×400 dpi to 2,400×2,400 dpi). The unit "dpi" as used in the invention means the number of dots per 2.54 cm.

As described above, in the case of active energy ray-curable ink like the ink composition of the present invention, the ink composition ejected is preferably kept at a constant temperature and therefore, the temperature in the region from the ink supply cartridge to the ink-jet head portion is preferably controlled by heat insulation and heating. Also, the head unit is preferably heated by thermally shielding or insulating the apparatus body so as not to receive an effect from the temperature of outer air. In order to shorten the printer start-up time necessary for heating or reduce the loss of heat active energy ray, in combination with thermal insulation from other sites, the heat capacity of the entire heating unit is preferably made small.

[Recording Medium]

The recording medium to which the ink composition of the present invention can be applied is not particularly limited and normal paper sheets such as non-coated paper and coated paper, and various non-absorptive resin materials and resin films shaped therefrom, which are used in so-called soft packaging, may be used. Examples of various plastic films include PET film, OPS film, OPP film, ONy film, PVC film, PE film and TAC film.

The constituent components for use in the ink composition usable in the present invention are described below in sequence.

[Ink Composition]

The ink composition for use in the present invention is an ink composition capable of being cured by the irradiation of active energy ray, and examples thereof include a cationic polymerization-type ink composition, a radical polymerization-type ink composition and an aqueous ink composition. These compositions are described in detail below.

(Cationic Polymerization-Type Ink Composition)

The cationic polymerization-type ink composition contains (a) a cationic polymerizable compound, (b) a compound capable of generating an acid upon irradiation with active energy ray and (c) a colorant and if desired, may further contain an ultraviolet absorbent, a sensitizer, an antioxidant, a discoloration inhibitor, electrically conducting salts, a solvent, a polymer compound, a surfactant and the like.

The constituent components used in the cationic polymerization-type ink composition are described below in sequence.

[(a) Cationic Polymerizable Compound]

The (a) cationic polymerizable compound for use in the present invention is not particularly limited as long as it is a compound capable of being cured by causing a polymerization reaction using an acid generated from the (b) compound capable of generating an acid upon irradiation with active energy ray, and various known cationic polymerizable monomers known as a photo-cationic polymerizable monomer may be used. Examples of the cationic polymerizable monomer include epoxy compounds, vinyl ether compounds and oxetane compounds described in JP-A-6-9714, JP-A-2001-31892, JP-A-2001-40068, JP-A-2001-55507, JP-A-2001-310938, JP-A-2001-310937 and JP-A-2001-220526.

Examples of the epoxy compound include an aromatic epoxide, an alicyclic epoxide and an aliphatic epoxide.

The aromatic epoxide includes a di- or polyglycidyl ether produced by the reaction of a polyhydric phenol having at least one aromatic nucleus or an alkylene oxide adduct thereof with epichlorohydrin. Examples thereof include a di- or polyglycidyl ether of bisphenol A or an alkylene oxide adduct thereof, a di- or polyglycidyl ether of hydrogenated bisphenol A or an alkylene oxide adduct thereof, and a novolak-type epoxy resin. Examples of the alkylene oxide include an ethylene oxide and a propylene oxide.

As for the alicyclic epoxide, a cyclohexene oxide- or cyclopentene oxide-containing compound obtained by epoxidizing a compound having at least one cycloalkene ring such as cyclohexene or cyclopentene ring with an appropriate oxidizing agent such as hydrogen peroxide and peracid is preferred.

Examples of the aliphatic epoxide include a di- or polyglycidyl ether of an aliphatic polyhydric alcohol or an alkylene oxide adduct thereof. Representative examples thereof include a diglycidyl ether of an alkylene glycol, such as diglycidyl ether of ethylene glycol, diglycidyl ether of propylene glycol, and diglycidyl ether of 1,6-hexanediol; a polyglycidyl ether of a polyhydric alcohol, such as di- or triglycidyl ether of glycerin or an alkylene oxide adduct thereof; and a diglycidyl ether of a polyalkylene glycol, as represented by a diglycidyl ether of a polyethylene glycol or an alkylene oxide adduct thereof, and a diglycidyl ether of a polypropylene glycol or an alkylene oxide adduct thereof. Here, examples of the alkylene oxide include an ethylene oxide and a propylene oxide.

The epoxy compound may be monofunctional or polyfunctional.

Examples of the monofunctional epoxy compound which can be used in the present invention include phenyl glycidyl ether, p-tert-butylphenyl glycidyl ether, butyl glycidyl ether, 2-ethylhexyl glycidyl ether, allyl glycidyl ether, 1,2-butylene oxide, 1,3-butadiene monoxide, 1,2-epoxydodecane, epichlorohydrin, 1,2-epoxydecane, styrene oxide, cyclohexene oxide, 3-methacryloyloxymethylcyclohexene oxide, 3-acryloyloxymethylcyclohexene oxide and 3-vinylcyclohexene oxide.

Examples of the polyfunctional epoxy compound include bisphenol A diglycidyl ether, bisphenol F diglycidyl ether, bisphenol S diglycidyl ether, brominated bisphenol A diglycidyl ether, brominated bisphenol F diglycidyl ether, brominated bisphenol S diglycidyl ether, epoxy novolak resin, hydrogenated bisphenol A diglycidyl ether, hydrogenated bisphenol F diglycidyl ether, hydrogenated bisphenol S diglycidyl ether, 3,4-epoxycyclohexylmethyl-3',4'-epoxycyclohexane carboxylate, 2-(3,4-epoxy-cyclohexyl-5,5-spiro-3,4-epoxy)cyclohexane-meta-dioxane, bis(3,4-epoxycyclohexylmethyl) adipate, vinylcyclohexene oxide, 4-vinylepoxycyclohexane, bis(3,4-epoxy-6-methylcyclohexylmethyl) adipate, 3,4-epoxy-6-methylcyclohexyl-3',4'-epoxy-6'-methylcyclohexane carboxylate, methylenebis(3,4-epoxycyclohexane), dicyclopentadiene diepoxide, di(3,4-epoxycyclohexylmethyl) ether of ethylene glycol, ethylenebis(3,4-epoxycyclohexane carboxylate), dioctyl epoxyhexahydrophthalate, di-2-ethylhexyl epoxyhexahydrophthalate, 1,4-butanediol diglycidyl ether, 1,6-hexanediol diglycidyl ether, glycerin triglycidyl ether, trimethylolpropane triglycidyl ether, polyethylene glycol diglycidyl ether, polypropylene glycol diglycidyl ethers, 1,1,3-tetradecadiene dioxide, limonene dioxide, 1,2,7,8-diepoxyoctane and 1,2,5,6-diepoxycyclooctane.

Among these epoxy compounds, an aromatic epoxide and an alicyclic epoxide are preferred in view of excellent curing rate, and an alicyclic epoxide is more preferred.

Examples of the vinyl ether compound include a di- or trivinyl ether compound such as ethylene glycol divinyl ether, diethylene glycol divinyl ether, triethylene glycol divinyl ether, propylene glycol divinyl ether, dipropylene glycol divinyl ether, butanediol divinyl ether, hexanediol divinyl ether, cyclohexanedimethanol divinyl ether and trimethylolpropane trivinyl ether; and a monovinyl ether compound such as ethyl vinyl ether, n-butyl vinyl ether, isobutyl vinyl ether, octadecyl vinyl ether, cyclohexyl vinyl ether, hydroxybutyl vinyl ether, 2-ethylhexyl vinyl ether, cyclohexanedimethanol monovinyl ether, n-propyl vinyl ether, isopropyl vinyl ether, isopropenyl ether-O-propylene carbonate, dodecyl vinyl ether, diethylene glycol monovinyl ether and octadecyl vinyl ether.

The vinyl ether compound may be monofunctional or polyfunctional.

Specifically, examples of the monofunctional vinyl ether include methyl vinyl ether, ethyl vinyl ether, propyl vinyl ether, n-butyl vinyl ether, tert-butyl vinyl ether, 2-ethylhexyl vinyl ether, n-nonyl vinyl ether, lauryl vinyl ether, cyclohexyl vinyl ether, cyclohexylmethyl vinyl ether, 4-methylcyclohexylmethyl vinyl ether, benzyl vinyl ether, dicyclopentenyl vinyl ether, 2-dicyclopentenoxyethyl vinyl ether, methoxyethyl vinyl ether, ethoxyethyl vinyl ether, butoxyethyl vinyl ether, methoxyethoxyethyl vinyl ether, ethoxyethoxyethyl vinyl ether, methoxypolyethylene glycol vinyl ether, tetrahydrofurfuryl vinyl ether, 2-hydroxyethyl vinyl ether, 2-hydroxypropyl vinyl ether, 4-hydroxybutyl vinyl ether, 4-hydroxymethylcyclohexylmethyl vinyl ether, diethylene glycol monovinyl ether, polyethylene glycol vinyl ether, chloroethyl vinyl ether, chlorobutyl vinyl ether, chloroethoxyethyl vinyl ether, phenylethyl vinyl ether and phenoxypolyethylene glycol vinyl ether.

Examples of the polyfunctional vinyl ether include divinyl ethers such as ethylene glycol divinyl ether, diethylene glycol divinyl ether, polyethylene glycol divinyl ether, propylene glycol divinyl ether, butylene glycol divinyl ether, hexanediol divinyl ether, bisphenol A alkylene oxide divinyl ether and bisphenol F alkylene oxide divinyl ether; and polyfunctional vinyl ethers such as trimethylolethane trivinyl ether, trimethylolpropane trivinyl ether, ditrimethylolpropane tetravinyl ether, glycerin trivinyl ether, pentaerythritol tetravinyl ether, dipentaerythritol pentavinyl ether, dipentaerythritol hexavinyl ether, ethylene oxide-added trimethylolpropane trivinyl ether, propylene oxide-added trimethylolpropane trivinyl ether, ethylene oxide-added ditrimethylolpropane tetravinyl ether, propylene oxide-added ditrimethylolpropane tetravinyl ether, ethylene oxide-added pentaerythritol tetravinyl ether, propylene oxide-added pentaerythritol tetravinyl ether, ethylene oxide-added dipentaerythritol hexavinyl ether and propylene oxide-added dipentaerythritol hexavinyl ether.

As for the vinyl ether compound, a di- or trivinyl ether compound is preferred in view of curing property, adhesion to recording medium, surface hardness of image formed, or the like, and a divinyl ether compound is more preferred.

The oxetane compound as referred to in the present invention indicates a compound having an oxetane ring, and known oxetane compounds described, for example, in JP-A-2001-220526, JP-A-2001-310937 and JP-A-2003-341217 may be arbitrarily selected and used.

The compound having an oxetane ring, which can be used in the ink composition of the present invention, is preferably a compound having from one to four oxetane rings in the structure thereof. When such a compound is used, the viscosity of the ink composition can be easily maintained in the range allowing for good handling, and high adhesion can be obtained between the ink composition after curing and the recording medium.

Such a compound having an oxetane ring is described in detail in paragraphs [0021] to [0084] of JP-A-2003-341217, and compounds described therein can be suitably used also in the present invention.

Out of the oxetane compounds for use in the present invention, a compound having one oxetane ring is preferably used in view of viscosity and tackiness of the ink composition.

In the ink composition of the present invention, one of these cationic polymerizable compounds may be used alone, or two or more species thereof may be used in combination, but from the standpoint of effectively controlling the shrinkage on curing the ink, at least one compound selected from oxetane compounds and epoxy compounds is preferably used in combination with a vinyl ether compound.

The content of the (a) cationic polymerizable compound in the ink composition is suitably from 10 to 95 mass %, preferably from 30 to 90 mass %, more preferably from 50 to 85 mass %, based on the entire solid content of the composition.

[(b) Compound Capable of Generating an Acid upon Irradiation with Active Energy Ray]

The ink composition of the present invention contains a compound capable of generating an acid upon irradiation with active energy ray (hereinafter appropriately referred to as a "photoacid generator").

The photoacid generator which can be used in the present invention may be appropriately selected from compounds capable of generating an acid upon irradiation with light (ultraviolet ray or far ultraviolet ray of 400 to 200 nm, preferably g-ray, h-ray, i-ray or KrF excimer laser light), ArF excimer laser light, electron beam, X-ray, molecular beam or ion beam, which are used in a photo-cationic polymerization photoinitiator, a photo-radical polymerization photoinitiator, a photo-decolorizing agent for coloring matters, a photo-discoloring agent, a micro resist or the like.

Examples of such a photoacid generator include an onium salt which decomposes upon irradiation with active energy ray to generate an acid, such as diazonium salt, ammnonium salt, phosphonium salt, iodonium salt, sulfonium salt, selenonium salt and arsonium salt; an organic halogen compound; an organic metal/organic halide; an o-nitrobenzyl type protective group-containing photoacid generator; a compound capable of undergoing photodecomposition to generate a sulfonic acid, as represented by imino sulfonate; a disulfone compound; a diazoketosulfone; and a diazodisulfone compound.

Furthermore, for example, oxazole derivatives and s-triazine derivatives described in paragraphs [0029] to [0030] of JP-A-2002-122994 may also be suitably used as the photoacid generator. In addition, onium salt compounds and sulfonate-based compounds described in paragraphs [0037] to [0063] of JP-A-2002-122994 may also be suitably used as the photoacid generator in the present invention.

As for the (b) photoacid generator, one species may be used alone or two or more species may be used in combination.

The content of the (b) photoacid generator in the ink composition is preferably from 0.1 to 20 mass %, more preferably from 0.5 to 10 mass %, still more preferably from 1 to 7 mass %, based on the entire solid content of the ink composition.

In the ink composition of the present invention, in addition to the above-described essential components, various additives may be used in combination according to the purpose. These arbitrary components are described below.

[(c) Colorant]

The ink composition of the present invention can form a visible image by adding thereto a colorant. For example, in the case of forming an image region of a lithographic printing plate, a colorant need not be necessarily added, but in view of suitability for plate inspection of the obtained lithographic printing plate, use of a colorant is also preferred.

The colorant which can be used here is not particularly limited, and various known coloring materials (pigment, dye) may be appropriately selected and used according to the usage. For example, in the case of forming an image with excellent weather resistance, a pigment is preferred. As for the dye, both a water-soluble dye and an oil-soluble dye may be used, but an oil-soluble dye is preferred.

[Pigment]

The pigment which is preferably used in the present invention is described below.

The pigment is not particularly limited and, for example, all organic and inorganic pigments generally available on the market, those obtained by dispersing a pigment in a dispersion medium such as insoluble resin, and those obtained by grafting a resin to the pigment surface may be used. In addition, those obtained by, for example, dyeing a resin particle with a dye may also be used.

Examples of such a pigment include pigments described in Seishiro Ito (compiler), *Ganryo No Jiten* (*Pigment Dictionary*), published in 2000, W. Herbst and K. Hunger, *Industrial Organic Pigments*, JP-A-2002-12607, JP-A-2002-188025, JP-A-2003-26978 and JP-A-2003-342503.

Specific examples of the organic and inorganic pigments which can be used in the present invention are as follows. Examples of the pigment which provides a yellow color include a monoazo pigment such as C.I. Pigment Yellow 1 (e.g., Fast Yellow G) and C.I. Pigment Yellow 74; a disazo pigment such as C.I. Pigment Yellow 12 (e.g., Disazo Yellow AAA) and C.I. Pigment Yellow 17; a non-benzidine-based azo pigment such as C.I. Pigment Yellow 180; an azo lake pigment such as C.I. Pigment Yellow 100 (e.g., Tartrazine Yellow Lake); a condensed azo pigment such as C.I. Pigment Yellow 95 (e.g., Condensed Azo Yellow GR); an acidic dye lake pigment such as C.I. Pigment Yellow 115 (e.g., Quinoline Yellow Lake); a basic dye lake pigment such as C.I. Pigment Yellow 18 (e.g., Thioflavine Lake); an anthraquinone-based pigment such as Flavanthrone Yellow (Y-24); an isoindolinone pigment such as Isoindolinone Yellow 3RLT (Y-110); a quinophthalone pigment such as Quinophthalone Yellow (Y-138); an isoindoline pigment such as Isoindoline Yellow (Y-139); a nitroso pigment such as C.I. Pigment Yellow 153 (e.g., Nickel Nitroso Yellow); and a metal complex salt azomethine pigment such as C.I. Pigment Yellow 117 (e.g., Copper Azomethine Yellow).

Examples of the pigment which provides a red or magenta color include a monoazo-based pigment such as C.I. Pigment Red 3 (e.g., Toluidine Red); a disazo pigment such as C.I. Pigment Red 38 (e.g., Pyrazolone Red B); an azo lake pigment such as C.I. Pigment Red 53:1 (e.g., Lake Red C) and C.I. Pigment Red 57:1 (Brilliant Carmine 6B); a condensed azo pigment such as C.I. Pigment Red 144 (e.g., Condensed Azo Red BR); an acidic dye lake pigment such as C.I. Pigment Red 174 (e.g., Phloxine B Lake); a basic dye lake pigment such as C.I. Pigment Red 81 (e.g., Rhodamine 6G' Lake); an anthraquinone-based pigment such as C.I. Pigment Red 177 (e.g., Dianthraquinonyl Red); a thioindigo pigment such as C.I. Pigment Red 88 (e.g., Thioindigo Bordeaux); a perinone pigment such as C.I. Pigment Red 194 (e.g., Perinone Red); a perylene pigment such as C.I. Pigment Red 149 (e.g., Perylene Scarlet); a quinacridone pigment such as C.I. Pigment Violet 19 (unsubstituted quinacridone) and C.I. Pigment Red 122 (e.g., Quinacridone Magenta); an isoindolinone pigment such as C.I. Pigment Red 180 (e.g., Isoindolinone Red 2BLT); and an alizarin lake pigment such as C.I. Pigment Red 83 (e.g., Madder Lake).

Examples of the pigment which provides a blue or cyan color include a disazo-based pigment such as C.I. Pigment Blue 25 (e.g., Dianisidine Blue); a phthalocyanine pigment such as C.I. Pigment Blue 15 (e.g., Phthalocyanine Blue); an acidic dye lake pigment such as C.I. Pigment Blue 24 (e.g., Peacock Blue Lake); a basic dye lake pigment such as C.I. Pigment Blue 1 (e.g., Victoria Pure Blue BO Lake); an anthraquinone-based pigment such as C.I. Pigment Blue 60 (e.g., Indanthrone Blue); and an alkali blue pigment such as C.I. Pigment Blue 18 (Alkali Blue V-5:1).

Examples of the pigment which provides a green color include a phthalocyanine pigment such as C.I. Pigment Green 7 (Phthalocyanine Green) and C.I. Pigment Green 36 (Phthalocyanine Green); and an azo metal complex pigment such as C.I. Pigment Green 8 (Nitroso Green).

Examples of the pigment which provides an orange color include an isoindoline-based pigment such as C.I. Pigment Orange 66 (Isoindoline Orange); and an anthraquinone-based pigment such as C.I. Pigment Orange 51 (Dichloropyranthrone Orange).

Examples of the pigment which provides a black color include carbon black, titanium black and aniline black.

Specific examples of the white pigment which can be used include basic lead carbonate ($2PbCO_3Pb(OH)_2$, so-called "silver white"), zinc oxide (ZnO, so-called "zinc white"), titanium oxide ($TiO_2$, so-called "titanium white"), strontium titanate ($SrTiO_3$, so-called "titanium strontium white").

Here, titanium oxide has a low specific gravity and a high refractive index and is chemically and physically stable as compared with other white pigments and therefore, this pigment ensures that the masking power and coloring power as a pigment are high and the durability against acid, alkali and other environments is excellent. Because of this, titanium oxide is preferably used as the white pigment. As a matter of course, other white pigments (may also be a white pigment other than those described above) may be used, if desired.

The pigment may be dispersed by using a dispersing device such as ball mill, sand mill, attritor, roll mill, jet mill, homogenizer, paint shaker, kneader, agitator, Henschel mixer, colloid mill, ultrasonic homogenizer, pearl mill and wet jet mill.

When dispersing the pigment, a dispersant may also be added. Examples of the dispersant include a hydroxyl group-containing carboxylic acid ester, a salt of long-chain polyaminoamide with high molecular weight acid ester, a salt of high molecular weight polycarboxylic acid, a high molecular weight unsaturated acid ester, a polymer copolymerization product, a modified polyacrylate, an aliphatic polyvalent carboxylic acid, a naphthalenesulfonic acid formalin condensate, a polyoxyethylene alkylphosphoric ester and a pigment derivative. A commercially available polymer dispersant such as Solsperse Series of Zeneca Ltd. may also be preferably used.

In addition, a synergist according to various pigments may be used as a dispersion aid. The dispersant or dispersion aid is preferably added in an amount of 1 to 50 parts by mass per 100 parts by mass of the pigment.

In the ink composition, a solvent may be added as a dispersion medium for Various components such as pigment, or the (a) cationic polymerizable compound which is a low molecular weight component may be used as a dispersion medium without using a solvent. However, since the ink composition of the present invention is an active energy-curable ink and the ink is applied onto a recording medium and then cured, the ink composition is preferably solvent-free. This is because when a solvent remains in the cured ink image, the solvent resistance may deteriorate or the residual solvent may cause a problem of VOC (volatile organic compound). From such a standpoint, the (a) cationic polymerizable compound is preferably used as the dispersion medium. Above all, in view of dispersion suitability or enhancement of handling property of the ink composition, a cationic polymerizable monomer having a lowest viscosity is preferably selected.

The average particle diameter of the pigment is preferably from 0.02 to 4 μm, more preferably from 0.02 to 2 μm, still more preferably from 0.02 to 1.0 μm.

The pigment, dispersant, dispersion medium and dispersion or filtration conditions are selected or set so that the pigment particle can have an average particle diameter in the above-described preferred range. By this control of the particle diameter, clogging of the head nozzle can be suppressed and the storage stability, transparency and curing sensitivity of ink can be maintained.

[Dye]

The dye for use in the present invention is preferably an oil-soluble dye. Specifically, the oil-soluble dye means a dye having a solubility in water at 25° C. (mass of the coloring matter dissolved in 100 g of water) of 1 g or less. The solubility is preferably 0.5 g or less, more preferably 0.1 g or less. Accordingly, a so-called water-insoluble oil-soluble dye is preferably used.

As regards the dye for use in the present invention, it is also preferred to introduce an oil-solubilizing group into the mother nucleus of the above-described dye for the purpose of dissolving a necessary amount of dye in the ink composition.

Examples of the oil-solubilizing group include a long-chain or branched alkyl group, a long-chain or branched alkoxy group, a long-chain or branched alkylthio group, a long-chain or branched alkylsulfonyl group, a long-chain or branched acyloxy group, a long-chain or branched alkoxycarbonyl group, a long-chain or branched acyl group, a long-chain or branched acylamino group, a long-chain or branched alkylsulfonylamino group, a long-chain or branched alkylaminosulfonyl group; and an aryl group, an aryloxy group, an aryloxycarbonyl group, an arylcarbonyloxy group, an arylaminocarbonyl group, an arylaminosulfonyl group and an arylsulfonylamino group, each containing the above-described long-chain or branched substituent.

Furthermore, the dye may be obtained from a water-soluble dye having a carboxyl acid or a sulfonic acid through conversion into an oil-solubilizing group, that is, an alkoxycarbonyl group, an aryloxycarbonyl group, an alkylaminosulfonyl group or an arylaminosulfonyl group, by using a long-chain or branched alcohol, an amine, a phenol or an aniline derivative.

The oil-soluble dye preferably has a melting point of 200° C. or less, more preferably 150° C. or less, still more preferably 100° C. By using an oil-soluble dye having a low melting point, crystal precipitation of the coloring matter in the ink composition is suppressed and the ink composition comes to have good storage stability.

Furthermore, for the purpose of improving resistance against fading, particularly against an oxidative substance such as ozone, or enhancing the curing property, the oxidation potential is preferably noble high). For this reason, the oil-soluble dye for use in the present invention preferably has an oxidation potential of 1.0 V (vs SCE) or more. A higher oxidation potential is preferred, and the oxidation potential is more preferably 1.1 V (vs SCE) or more, still more preferably 1.15 V (vs SCE) or more.

As for the dye of yellow color, compounds having a structure represented by formula (Y-1) of JP-A-2004-250483 are preferred.

Dyes represented by formulae (Y-II) to (Y-IV) described in paragraph [0034] of JP-A-2004-250483 are more preferred. Specific examples thereof include compounds described in paragraphs [0060] to [0071] of JP-A-2004-250483. Incidentally, the oil-soluble dye of formula (Y-I) described in the patent publication above may be used not only for yellow ink but also for ink of any color, such as black ink and red ink.

As for the dye of magenta color, compounds having a structure represented by formula (3) or (4) described in JP-A-2002-114930 are preferred. Specific examples thereof include the compounds described in paragraphs [00541] to [0073] of JP-A-2002-114930.

Azo dyes represented by formulae (M-1) to (M-2) described in paragraphs [0084] to [0122] of JP-A-2002-121414 are more preferred, and specific examples thereof include the compounds described in paragraphs [0123] to [0132] of JP-A-2002-121414. Incidentally, the oil-soluble dyes of formulae (3), (4) and (M-1) to (M-2) described in these patent publications may be used not only for magenta ink but also for ink of any color, such as black ink and red ink.

As for the dye of cyan color, dyes represented by formulae (I) to (IV) of JP-A-2001-181547 and dyes represented by formulae (IV-1) to (IV-4) described in paragraphs [0063] to [0078] of JP-A-2002-121414 are preferred. Specific examples thereof include the compounds described in paragraphs [0052] to [0066] of JP-A-2001-181547 and the compounds described in paragraphs [0079] to [0081] of JP-A-2002-121414.

Phthalocyanine dyes represented by formulae (C-I) and (C-II) described in paragraphs [0133] to [0196] of JP-A-2002-121414 are more preferred, and the phthalocyanine dye represented by formula (C-II) is still more preferred. Specific examples thereof include the compounds described in paragraphs [0198] to [0201] of JP-A-2002-121414. Incidentally, the oil-soluble dyes of formulae (I) to (IV), (IV-1) to (IV-4), (C-I) and (C-II) may be used not only for cyan ink but also for ink of any color, such as black ink and green ink.

Such a colorant is preferably added in an amount of, in terms of the solid content, from 1 to 20 mass %, more preferably from 2 to 10 mass %, based on the ink composition.

[Other Components]

Various additives which may be used if desired are described below.

[Ultraviolet Absorbent]

In the present invention, an ultraviolet absorbent may be used from the standpoint of giving an image enhanced in the weather resistance and prevented from fading.

Examples of the ultraviolet absorbent include benzotriazole-based compounds described in JP-A-58-185677, JP-A-61-190537, JP-A-2-782, JP-A-5-197075 and JP-A-9-34057; benzophenone-based compounds described in JP-A-46-2784, JP-A-5-194483 and U.S. Pat. No. 3,214,463; cinnamic acid-based compounds described in JP-B-48-30492 (the term "JP-B" as used herein means an "examined Japanese patent application"), JP-B-56-21141 and JP-A-10-88106; triazine-based compounds described in JP-A-4-298503, JP-A-8-53427, JP-A-8-239368, JP-A-10-182621 and JP-T-8-501291 (the term (the term "JP-T" as used herein means a "published Japanese translation of a PCT patent application"); compounds described in Research Disclosure, No. 24239; and compounds capable of absorbing ultraviolet ray to emit fluorescence, so-called fluorescent brightening agent, as represented by a stilbene-based compound and a benzoxazole-based compound.

The amount of the ultraviolet absorbent added is appropriately selected according to the purpose but is generally on the order of 0.5 to 15 mass % in terms of the solid content.

[Sensitizer]

In the ink composition of the present invention, if desired, a sensitizer may be added for the purpose of enhancing the acid generation efficiency of the photoacid generator and shifting the photosensitive wavelength to a long wavelength side. The sensitizer may be any sensitizer as long as it can sensitize the photoacid generator by an electron or an active energy ray transfer mechanism. Preferred examples thereof include an aromatic polycondensed ring compound such as anthracene, 9,10-dialkoxyanthracene, pyrene and perylene; an aromatic ketone compound such as acetophenone, benzophenone, thioxanthone and Michler's ketone; and a heterocyclic compound such as phenothiazine and N-aryloxazolidinone. The amount of the sensitizer added is appropriately selected according to the purpose but is generally from 0.01 to 1 mol %, preferably from 0.1 to 0.5 mol %, based on the photoacid generator.

[Antioxidant]

An antioxidant may be added for the purpose of enhancing the stability of the ink composition. Examples of the antioxidant include those described in EP-A-223739, EP-A-309401, EP-A-309402, EP-A-310551, EP-A-310552, EP-A-459416, German Unexamined Patent Publication No. 3435443, JP-A-54-48535, JP-A-62-262047, JP-A-63-113536, JP-A-63-163351, JP-A-2-262654, JP-A-2-71262, JP-A-3-121449, JP-A-5-61166, JP-A-5-119449, and U.S. Pat. Nos. 4,814,262 and 4,980,275.

The amount of the antioxidant added is appropriately selected according to the purpose but is generally on the order of 0.1 to 8 mass % in terms of the solid content.

[Anti-Fading Agent]

In the ink composition of the present invention, various organic or metal complex-based anti-fading agents may be used. Examples of the organic anti-fading agent include hydroquinones, alkoxyphenols, dialkoxyphenols, phenols, anilines, amines, indanes, chromans, alkoxyanilines and heterocyclic compounds. Examples of the metal complex-based anti-fading agent include a nickel complex and a zinc complex, and specifically, there may be used the compounds described in patents cited in *Research Disclosure*, No. 17643, No. VII, Items I to J, ibid., No. 15162, ibid., No. 18716, page 650, left column, ibid., No. 36544, page 527, ibid., No. 307105, page 872, and ibid., No. 15162; and the compounds included in formulae of representative compounds and in examples of the compounds describe on JP-A-62-215272, pp. 127-137.

The amount of the anti-fading agent added is appropriately selected according to the purpose but is generally on the order of 0.1 to 8 mass % in terms of the solid content.

[Electrically Conducting Salts]

In the ink composition of the present invention, electrically conducting salts such as potassium thiocyanate, lithium nitrate, ammonium thiocyanate and dimethylamine hydrochloride may be added for the purpose of controlling the ejection physical property.

[Solvent]

In the ink composition of the present invention, addition of an organic solvent in an extremely small amount is also effective for the purpose of improving the adhesion to a recording medium.

Examples of the solvent include a ketone-based solvent such as acetone, methyl ethyl ketone and diethyl ketone; an alcohol-based solvent such as methanol, ethanol, 2-propanol, 1-propanol, 1-butanol and tert-butanol; a chlorine-based solvent such as chloroform and methylene chloride; an aromatic solvent such as benzene and toluene; an ester-based solvent such as ethyl acetate, butyl acetate and isopropyl acetate; an ether-based solvent such as diethyl ether, tetrahydrofuran and dioxane; and a glycol ether-based solvent such as ethylene glycol monomethyl ether and ethylene glycol dimethyl ether.

In this case, addition in the range of not causing a problem in the solvent resistance or VOC is effective, and this amount is preferably from 0.1 to 5 mass %, more preferably from 0.1 to 3 mass %, based on the entire ink composition.

[Polymer Compound]

In the ink composition of the present invention, various polymer compounds may be added for the purpose of adjusting the film physical properties. Examples of the polymer compound which can be used include an acryl-based polymer, a polyvinyl butyral resin, a polyurethane resin, a polyamide resin, a polyester resin, an epoxy resin, a phenol resin, a polycarbonate resin, a polyvinyl butyral resin, a polyvinyl formal resin, a shellac, a vinyl-based resin, an acryl-based resin, a rubber-based resin, waxes and other natural resins. Also, two or more species thereof may be used in combination. Among these, a vinyl-based copolymer obtainable by the copolymerization of an acryl-based monomer is preferred. In addition, as for the copolymerization composition of the polymer binder, a copolymer containing, as the structural unit, a "carboxyl group-containing monomer", an "alkyl methacrylate" or an "alkyl acrylate" is also preferably used.

[Surfactant]

In the ink composition of the present invention, a surfactant may also be added.

The surfactant includes those described in JP-A-62-173463 and JP-A-62-183457. Examples thereof include an anionic surfactant such as dialkylsulfosuccinates, alkylnaphthalenesulfonates and fatty acid salts; a nonionic surfactant such as polyoxyethylene alkyl ethers, polyoxyethylene alkylallyl ethers, acetylene glycols and polyoxyethylene-polyoxypropylene block copolymers; and a cationic surfactant such as alkylamine salts and quaternary ammonium salts. Incidentally, an organic fluoro compound may be used in place of the surfactant above. The organic fluoro compound is preferably hydrophobic. Examples of the organic fluoro compound include a fluorine-containing surfactant, an oily fluorine-containing compound (e.g., fluorine oil), a solid fluorine compound resin (e.g., tetrafluoroethylene resin), and those described in JP-B-57-9053 (columns 8 to 17) and JP-A-62-135826.

Other than these, for example, a leveling additive, a matting agent, waxes for adjusting the film physical properties, and a tackifier for improving adhesion to a recording medium such as polyolefin and PET, which does not inhibit the polymerization, may be added, if desired.

Specific examples of the tackifier include high molecular weight adhesive polymers described in JP-A-2001-49200, pp. 5-6 (for example, a copolymer comprising an ester of a (meth)acrylic acid and an alcohol containing an alkyl group having a carbon number of 1 to 20, an ester of a (meth)acrylic acid and an alicyclic alcohol having a carbon number of 3 to 14, or an ester of a (meth)acrylic acid and an aromatic alcohol having a carbon number of 6 to 14); and a low molecular weight tackifier resin having a polymerizable unsaturated bond.

It is preferable that the surface tension of each ink composition used in the invention be 20 to 40 mN/m, and it is even preferable that the surface tension of each ink composition be 25 to 35 mN/m. Where recording is performed on various recording media such as a polyolefin medium, a PET medium, coated paper, and non-coated paper, it is preferable that the surface tension be higher than or equal to 20 mN/m from the viewpoint of soaking and permeation performance and be lower than or equal to 40 mN/m from the viewpoint of wettability.

In the invention, each thus-adjusted ink composition is used appropriately as an ink-jet recording ink. When used as an ink-jet recording ink, recording is performed in such a manner that an ink composition is emitted toward a recording medium by an ink-jet printer and then set by illuminating it with radiation.

Image portions of a printed material produced by using such inks have been set through irradiation with radiation such as an active energy ray and hence are high in strength. Therefore, such inks can be used for various purposes other than image formation, such as formation of the ink accepting layer (image portions) of a lithography printing plate.

[Radical Polymerization-Type Ink Composition]

The radical polymerization-type ink composition contains (d) a radical polymerizable compound, (e) a polymerization initiator and (i) a colorant and, if desired, may further contain a colorant, a sensitizing dye, a co-sensitizer and the like.

The constituent components used in the radical polymerization-type ink composition are described below in sequence.

[Radical Polymerizable Compound]

The radical polymerizable compound includes, for example, the following compound having an addition-polymerizable ethylenically unsaturated bond.

[Compound Having Addition-Polymerizable Ethylenically Unsaturated Bond]

Examples of the compound having an addition-polymerizable ethylenically unsaturated bond, which can be used in the ink composition of the present invention, include an ester of an unsaturated carboxylic acid (e.g., acrylic acid, methacrylic acid, itaconic acid, crotonic acid, isocrotonic acid, maleic acid) and an aliphatic polyhydric alcohol compound, and an amide of the above-described unsaturated carboxylic acid and an aliphatic polyvalent amine compound.

Specific examples of the ester monomer of an aliphatic polyhydric alcohol compound and an unsaturated carboxylic acid include the followings. Examples of the acrylic ester include ethylene glycol diacrylate, triethylene glycol diacrylate, 1,3-butanediol diacrylate, tetramethylene glycol diacrylate, propylene glycol diacrylate, neopentyl glycol diacrylate, trimethylolpropane triacrylate, trimethylolpropane tri(acryloyloxypropyl) ether, trimethylolethane triacrylate, hexanediol diacrylate, 1,4-cyclohexanediol diacrylate, tetraethylene glycol diacrylate, pentaerythritol diacrylate, pentaerythritol triacrylate, pentaerythritol tetraacrylate, dipentaerythritol diacrylate, dipentaerythritol hexaacrylate, sorbitol triacrylate, sorbitol tetraacrylate, sorbitol pentaacrylate, sorbitol hexaacrylate, tri(acryloyloxyethyl) isocyanurate, and polyester acrylate oligomer.

Examples of the methacrylic acid ester include tetramethylene glycol dimethacrylate, triethylene glycol dimethacrylate, neopentyl glycol dimethacrylate, trimethylolpropane trimethacrylate, trimethylolethane trimethacrylate, ethylene glycol dimethacrylate, 1,3-butanediol dimethacrylate, hexanediol dimethacrylate, pentaerytritol dimethacrylate, pentaerythritol trimethacrylate, pentaerythritol tetramethacrylate, dipentaerythritol dimethacrylate, dipentaerythritol hexamethacrylate, sorbitol trimethacrylate, sorbitol tetramethacrylate, bis[p-(3-methacryloxy-2-hydroxypropoxy) phenyl]dimethylmethane, and bis[p-(acryloxyethoxy)phenyl]dimethylmethane. Examples of itaconic acid ester include ethylene glycol diitaconate, propylene glycol diitaconate, 1,3-butanediol diitaconate, 1,4-butanediol diitaconate, tetramethylene glycol diitaconate, pentaerythritol diitaconate, and sorbitol tetraitaconate.

Examples of the crotonic acid ester include ethylene glycol dicrotonate, tetramethylene glycol dicrotonate, pentaerythritol dicrotonate, and sorbitol tetradicrotonate. Examples of the isocrotonic acid ester include ethylene glycol diisocrotonate, pentaerythritol diisocrotonate and sorbitol tetraisocrotonate. Examples of the maleic acid ester include ethylene glycol dimaleate, triethylene glycol dimaleate, pentaerythritol dimaleate and sorbitol tetramaleate. In addition, a mixture of these ester monomers may also be used. Specific examples of the amide monomer of an aliphatic polyvalent amine compound and an unsaturated carboxylic acid include methylenebis-acrylamide, methylenebis-methacrylamide, 1,6-hexamethylenebis-acrylamide, 1,6-hexamethylenebis-methacrylamide, diethylene triamine trisacrylamide, xylylenebisacrylamide, and xylylenebismethacrylamide.

Other examples include a vinyl urethane compound containing two or more polymerizable vinyl groups within one molecule, which is obtained by adding a hydroxyl group-containing vinyl monomer represented by the following formula (A) to a polyisocyanate compound containing two or more isocyanate groups within one molecule, described in JP-B-48-41708. $CH_2=C(R)COOCH_2CH(R')OH$ (A) (wherein R and R' each represents H or $CH_3$).

Still other examples include a functional acrylate or methacrylate such as urethane acrylates described in JP-A-51-37193, polyester acrylates described in JP-A-48-64183, JP-B-49-43191 and JP-B-52-30490, and epoxy acrylates obtained by reacting an epoxy resin and a (meth)acrylic acid. Furthermore, those described as a photocurable monomer or oligomer in *Journal of the Adhesion Society of Japan*, Vol. 20, No. 7, pp. 300-308 (1984) may also be used. In the present invention, these monomers can be used in a chemical form such as a prepolymer, namely, dimer, trimer or oligomer, or a mixture or copolymer thereof.

The amount of the radical polymerizable compound used is usually from 1 to 99.99%, preferably from 5 to 90.0%, more preferably from 10 to 70% ("%" as used herein indicates "mass %"), based on all components of the ink composition.

[Polymerization Initiator]

The polymerization initiator for use in the radical polymerization-type ink composition of the present invention is described below.

The polymerization initiator as used in the present invention indicates a compound capable of undergoing a chemical change under the action of light or through interaction with the electron excited state of a sensitizing dye and thereby producing at least one species of a radical, an acid and a base.

Preferred examples of the polymerization initiator include (i) aromatic ketones, (ii) an aromatic onium salt compound, (iii) an organic peroxide, (iv) a hexaarylbiimidazole compound, (v) a ketoxime ester compound, (vi) a borate compound, (vii) an azinium compound, (viii) a metallocene compound, (vix) an active ester compound, and (x) a carbon-halogen bond-containing compound.

[Sensitizing Dye]

In the present invention, a sensitizing dye may be added for the purpose of improving the sensitivity of the photopolymerization initiator. Preferred examples of the sensitizing dye include those belonging to the following compounds and having an absorption wavelength in the region from 350 to 450 nm.

That is, the compounds are polynuclear aromatics (e.g., pyrene, perylene, triphenylene), xanthenes (e.g., fluorescein, eosin, erythrosin, Rhodamine B, Rose Bengale), cyanines (e.g., thiacarbocyanine, oxacarbocyanine), merocyanines (e.g., merocyanine, carbomerocyanine), thiazines (e.g., thionine, Methylene Blue, Toluidine Blue), acridines (e.g., Acridine Orange, chloroflavin, acriflavine), anthraquinones (e.g., anthraquinone), squaryliums (e.g., squarylium), and coumarins (e.g., 7-diethylamino-4-methylcoumarin).

[Co-Sensitizer]

Furthermore, in the ink of the present invention, a known compound having an activity of, for example, more enhancing the sensitivity or suppressing the polymerization inhibition by oxygen may be added as a co-sensitizer.

Examples of such a co-sensitizer include amines such as compounds described in M. R. Sander, et al., *Journal of Polymer Society*, Vol. 10, page 3173 (1972), JP-B-44-20189, JP-A-51-82102, JP-A-52-134692, JP-A-59-138205, JP-A-60-84305, JP-A-62-18537, JP-A-64-33104, and *Research Disclosure*, No. 33825. Specific examples thereof include triethanolamine, ethyl p-dimethylaminobenzoate, p-formyldimethylaniline and p-methylthiodimethylaniline.

Other examples include thiols and sulfides such as thiol compounds described in JP-A-53-702, JP-B-55-500806, and JP-A-5-142772 and disulfide compounds described in JP-A-56-75643. Specific examples thereof include 2-mercaptobenzotiazole, 2-mercaptobenzoxazole, 2-mercaptobenzimidazole, 2-mercapto-4(3H)-quinazoline and β-mercaptonaphthalene.

Still other examples include an amino acid compound (e.g., N-phenylglycine), organometallic compounds described in JP-B-48-42965 (e.g., tributyltin acetate), hydrogen donors described in JP-B-55-34414, sulfur compounds described in JP-A-6-308727 (e.g., trithian), phosphorus compounds described in JP-A-6-250387 (e.g., diethyl phosphite), and Si—H and Ge—H compounds described in Japanese Patent Application No. 6-191605.

Also, in view of enhancing the storability, a polymerization inhibitor is preferably added in an amount of 200 to 20,000 ppm. The ink for ink-jet recording of the present invention is preferably ejected after heating it in the range from 40 to 80° C. and thereby decreasing the viscosity, and also for preventing head clogging due to thermal polymerization, addition of a polymerization inhibitor is preferred. Examples of the polymerization inhibitor include hydroquinone, benzoquinone, p-methoxyphenol, TEMPO, TEMPOL and cupferron Al.

[Others]

In addition, known compounds may be used as needed. For example, a surfactant, a leveling additive, a mating agent and, for adjusting the film physical properties, a polyester-based resin, a polyurethane-based resin, a vinyl-based resin, an acryl-based resin, a rubber-based resin or waxes, may be appropriately selected and used. Furthermore, in order to improve the adhesion to a recording medium such as polyolefin and PET, a tackifier which does not inhibit the polymerization is also preferably contained. Specific examples thereof include high molecular weight adhesive polymers described in JP-A-2001-49200, pp. 5-6 (for example, a copolymer comprising an ester of a (meth)acrylic acid and an alcohol containing an alkyl group having a carbon number of 1 to 20, an ester of a (meth)acrylic acid and an alicyclic alcohol having a carbon number of 3 to 14, or an ester of a (meth)acrylic acid and an aromatic alcohol having a carbon number of 6 to 14); and a low molecular weight tackifier resin having a polymerizable unsaturated bond.

Also, addition of an organic solvent in an extremely small amount is effective for the purpose of improving adhesion to a recording medium. In this case, addition in the range of not causing a problem in the solvent resistance or VOC is effective, and this amount is preferably from 0.1 to 5 mass %, more preferably from 0.1 to 3 mass %, based on the entire ink composition.

Furthermore, as the means for preventing reduction in the sensitivity due to light-shielding effect of the coloring material in the ink, it is also one preferred embodiment to form a radical/cation hybrid-type curing ink by combining a cationic polymerizable monomer having a long life as the polymerization initiator with a polymerization initiator.

[Aqueous Ink Composition]

The aqueous ink composition contains a polymerizable compound and a water-soluble photopolymerization initiator capable of generating a radical under the action of active energy and if desired, may further contain a colorant and the like.

[Polymerizable Compound]

As for the polymerizable compound contained in the aqueous ink composition of the present invention, a polymerizable compound contained in known aqueous ink compositions may be used.

In the aqueous ink composition, a reactive material may be added so as to optimize the formulation by taking into account end user characteristics such as curing rate, adhesion and flexibility. For example, a (meth)acrylate (namely, acrylate and/or methacrylate) monomer or oligomer, an epoxide and an oxetane are used as such a reactive material.

Examples of the acrylate monomer include a phenoxyethyl acrylate, an octyldecyl acrylate, a tetrahydrofuryl acrylate, an isobornyl acrylate, a hexanediol diacrylate, a trimethylolpropane triacrylate, a pentaerythritol triacrylate, a polyethylene glycol diacrylate (e.g., tetraethylene glycol diacrylate), a dipropylene glycol diacrylate, a tri(propylene glycol) triacrylate, a neopentyl glycol diacrylate, a bis(pentaerythritol) hexaacrylate, an acrylate of ethoxylated or propoxylated glycol and polyol (e.g., propoxylated neopentyl glycol diacrylate, ethoxylated trimethylolpropane triacrylate), and a mixture thereof.

Examples of the acrylate oligomer include an ethoxylated polyethylene glycol, an ethoxylated trimethylolpropane acrylate, a polyether acrylate including its ethoxylated product, and a urethane acrylate oligomer.

Examples of the methacrylate include a hexanediol dimethacrylate, a trimethylolpropane trimethacrylate, a triethylene glycol dimethacrylate, a diethylene glycol dimethacrylate, an ethylene glycol dimethacrylate, a 1,4-butanediol dimethacrylate, and a mixture thereof.

The amount of the oligomer added is preferably from 1 to 80 wt %, more preferably from 1 to 10 wt %, based on the entire weight of the ink composition.

[Water-Soluble Photopolymerization Initiator Capable of Producing a Radical Under the Action of Active Energy Ray]

The polymerization initiator which can be used in the ink composition of the present invention is described below. As one example, a photopolymerization initiator up to a wavelength of around 400 nm may be used. Examples of such a photopolymerization initiator include photopolymerization initiators represented by the following formulae, which are a substance having functionality in a long wavelength region, namely, sensitivity of producing a radical when irradiated with active energy ray (hereinafter simply referred to as a "TX system"). In the present invention, particularly, a photopolymerization initiator appropriately selected from these is preferably used.

TX-1

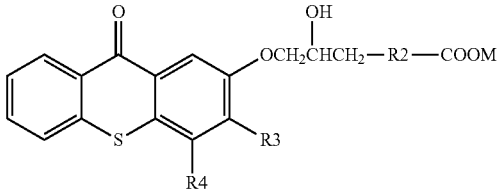

TX-2

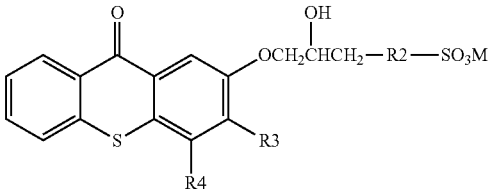

TX-3

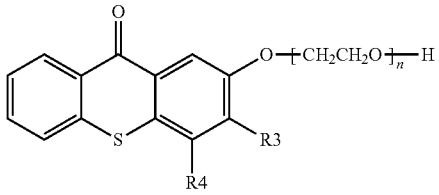

In formulae TX-1 to TX-3, R2 represents $—(CH_2)_x—$ (wherein x is 0 or 1), $—O—(CH_2)_y—$(wherein y is 1 or 2), or a substituted or unsubstituted phenylene group. When R2 is a phenylene group, at least one of the hydrogen atoms in the benzene ring may be substituted by one group or atom or two or more groups or atoms selected from, for example, a carboxyl group or a salt thereof, a sulfonic acid or a salt thereof, a linear or branched alkyl group having a carbon number of 1 to 4, a halogen atom (e.g., fluorine, chlorine, bromine), an alkoxyl group having a carbon number of 1 to 4, and an aryloxy group such as phenoxy group. M represents a hydrogen atom or an alkali metal (e.g., Li, Na, K). R3 and R4 each independently represents a hydrogen atom or a substituted or unsubstituted alkyl group. Examples of the alkyl group include a linear or branched alkyl group having a carbon number of approximately from 1 to 10, particularly, a carbon number of approximately from 1 to 3. Examples of the substituent for this alkyl group include a halogen atom (e.g., fluorine, chlorine, bromine), a hydroxyl group, and an alkoxyl group (having a carbon number of approximately from 1 to 3). m represents an integer of 1 to 10.

In the present invention, a water-soluble derivative of a photopolymerization initiator, Irgacure 2959 (trade name, produced by Ciba Specialty Chemicals), represented by the following formula (hereinafter simply referred to as an "IC system") may be used. Specifically, IC-1 to IC-3 of the following formulae may be used.

Formula

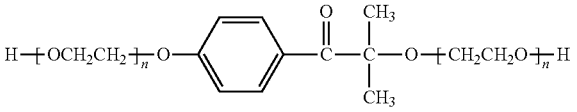

(n = 2~5, m = 0~5)

IC-1

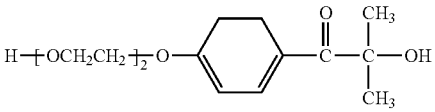

IC-2

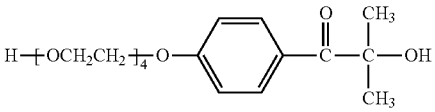

IC-3

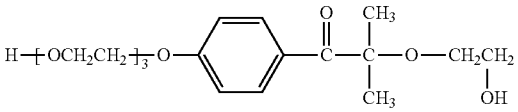

[Formulation for Clear Ink]

By using the water-soluble polymerizable compound in the form of a transparent aqueous ink without incorporating the above-described colorant, a clear ink can be prepared. In particular, when the ink is prepared to have ink-jet recording property, an aqueous photocuring-type clear ink for ink-jet recording is obtained. This ink contains no colorant and therefore, a clear film can be obtained by using the ink. Examples of the usage of the colorant-free clear ink include use as an undercoat for imparting suitability for image printing to a recording material, and use as an overcoat for protecting the surface of an image formed by a normal ink or further imparting decoration, gloss or the like. In the clear ink, a colorless pigment, a fine particle or the like not for the purpose of coloration may be incorporated by dispersion according to the usage above. By this addition, various properties such as image quality, fastness and processability (handling property) of a printed matter can be enhanced in both cases of undercoat and overcoat.

As for the formulation conditions in such application to a clear ink, the ink is preferably prepared to contain a water-soluble polymerizable compound as the main component of the ink in a proportion of 10 to 85% and a photopolymerization initiator (for example, an active energy ray polymerization catalyst) in an amount of 1 to 10 parts by mass per 100 parts by mass of the water-soluble polymerizable compound and at the same time, contain a photopolymerization initiator in an amount of at least 0.5 parts per 100 parts of the ink.

[Material Construction in Colorant-Containing Ink]

In the case of using the water-soluble polymerizable compound for a colorant containing ink, the concentrations of the polymerization initiator and polymerizable substance in the ink are preferably adjusted according to the absorption characteristics of the colorant contained. As described above, the blending amount is set such that the amount of water or solvent is, on the mass basis, from 40 to 90%, preferably from 60 to 75%. Also, the content of the polymerizable compound in the ink is set to, on the mass basis, from 1 to 30%, preferably from 5 to 20%, based on the entire amount of the ink. The amount of the polymerization initiator depends on the content of the polymerizable compound but is generally, on the mass basis, from 0.1 to 7%, preferably from 0.3 to 5%, based on the entire amount of the ink.

In the case where a pigment is used as the colorant of the ink, the concentration of the pure pigment portion in the ink is generally from 0.3 to 10 mass % based on the entire amount of the ink. The coloring power of the pigment depends on the dispersed state of pigment particles, but when the concentration is approximately from 0.3 to 1%, this is in the range of use as a light color ink, whereas the value exceeding the range above gives a concentration employed for normal coloration.

[Preferable Material Properties of Ink Composition]

In view of the jetting performance, it is preferable that the ink viscosity of each ink composition used in the invention be 7 to 30 mPa·s at a temperature at the time of jetting. It is even preferable that the ink viscosity of each ink composition be 7 to 20 mPa·s at a temperature at the time of jetting. It is preferable that the proportions of the constituent elements be adjusted so that the ink viscosity falls within the above range. In a temperature range of 25 to 30° C., the ink viscosity should be 35 to 500 mPa·s, preferably 35 to 200 mPa·s. Setting the viscosity at room temperature makes it possible to prevent ink permeation into even a porous recording medium, reduce the amount of unset monomers, and lower the degree of a bad smell, and, furthermore, to suppress dot blurring at the time of impact of ink droplets, whereby image quality is improved. If the ink viscosity at 25 to 30° C. is lower than 35 mPa·s, the blurring suppression effect is small. Conversely, if the ink viscosity at 25 to 30° C. is higher than 500 mPa·s, trouble will occur in ink liquid delivery.

This application is based on Japanese Patent application JP 2007-9164, filed Jan. 18, 2007, and Japanese Patent application JP 2007-59887, filed Mar. 9, 2007, the entire contents of which are hereby incorporated by reference, the same as if fully set forth herein.

Although the invention has been described above in relation to preferred embodiments and modifications thereof it will be understood by those skilled in the art that other variations and modifications can be effected in these preferred embodiments without departing from the scope and spirit of the invention.

What is claimed is:

1. An ink-jet recording apparatus comprising:

a recording medium transport unit for transporting a recording medium;

an ink-jet head for discharging ink that can be set when illuminated with ultraviolet light toward the recording medium being transported by the recording medium transport unit on the basis of an image signal; and an ultraviolet light illumination unit for setting the ink that has been discharged and placed on the recording medium by the ink-jet head, wherein:

the ultraviolet light illumination unit comprises a plurality of hot-cathode tubes having an aperture with an aperture angle of in a range of from 45° to 180°, wherein said plurality of hot-cathode tubes each having a phosphor layer whose thickness increases from one end of the hot-cathode tube to an other end of the hot-cathode tube, the hot-cathode tubes being arranged parallel with each other in such a manner that directions in which the thickness of the phosphor layers of the respective hot-cathode tubes increases are opposite to each other.

2. An ink-jet recording apparatus comprising:

a recording medium transport unit for transporting a recording medium;

an ink-jet head for discharging ink that can be set when illuminated with ultraviolet light toward the recording medium being transported by the recording medium transport unit on the basis of an image signal; and an ultraviolet light illumination unit for setting the ink that has been discharged and placed on the recording medium by the ink-jet head, wherein:

the ultraviolet light illumination unit comprises a plurality of hot-cathode tubes having an aperture with an aperture angle of in a range of from 45° to 180°, wherein the aperture of one set of hot-cathode tubes are rotated so that an overlap of their illumination region is increased, and wherein the aperture of at least one hot-cathode tube of the at least one set of aperture-type hot-cathode tubes is rotated so that a line connecting a center axis of a cylinder of the hot-cathode tube and a center of the aperture is oblique to the recording medium so that light intensity peaks of the at least one set of hot-cathode tubes are located at a same position.

3. An ink-jet recording apparatus comprising:

a recording medium transport unit for transporting a recording medium;

an ink-jet head for discharging ink that can be set when illuminated with ultraviolet light toward the recording medium being transported by the recording medium transport unit on the basis of an image signal; and an ultraviolet light illumination unit for setting the ink that has been discharged and placed on the recording medium by the ink-jet head, wherein:

the ultraviolet light illumination unit comprises a plurality of hot-cathode tubes having an aperture with an aperture angle of in a range of from 45° to 180°, wherein the aperture of one set of hot-cathode tubes are rotated so that an overlap of their illumination region is increased, and wherein each of the hot-cathode tubes has a phosphor layer whose thickness increases from one end of the hot-cathode tube to an other end, the hot-cathode tubes being arranged parallel with each other in such a manner that directions in which the thickness of the phosphor layers of the respective hot-cathode tubes increases are opposite to each other.

* * * * *